US005456096A

United States Patent [19]

Mitsumoto et al.

[11] Patent Number: 5,456,096

[45] Date of Patent: Oct. 10, 1995

[54] METHOD FOR PROCESSING END PORTION OF FABRIC

[75] Inventors: Shigenobu Mitsumoto; Masao Okuno, both of Wakayama, Japan

[73] Assignee: Shima Seiki Mfg. Ltd., Wakayama, Japan

[21] Appl. No.: 220,576

[22] Filed: Mar. 31, 1994

Related U.S. Application Data

[63] Continuation of Ser. No. 730,552, Jul. 16, 1991, abandoned.

[30] Foreign Application Priority Data

Jul. 17, 1990 [JP] Japan ..... 2-189983

[51] Int. Cl.[6] ..... D04B 7/00

[52] U.S. Cl. ..... 66/69; 66/75.1; 66/172 R

[58] Field of Search ..... 66/179, 69, 176, 66/172 R, 169 R, 169 A, 170, 171, 89, 75.1

[56] References Cited

U.S. PATENT DOCUMENTS

| | | | |
|---|---|---|---|
| 3,581,325 | 6/1971 | Betts et al. | 66/173 |
| 3,702,068 | 11/1972 | Betts et al. | 66/176 |
| 4,548,057 | 10/1985 | Essig | 66/172 R |
| 4,691,537 | 9/1987 | Cullen et al. | 66/172 R |

FOREIGN PATENT DOCUMENTS

| | | | |
|---|---|---|---|
| 2183264 | 1/1987 | United Kingdom | 66/176 |

*Primary Examiner*—Clifford D. Crowder
*Assistant Examiner*—Larry D. Worrell, Jr.
*Attorney, Agent, or Firm*—Spensley Horn Jubas & Lubitz

[57] ABSTRACT

A method for processing end portion of fabric knitted by a flat knitting machine wherein integration of fabrics and the anti-raveling of end portion at the completion of knitting are carried out and the joined portion is not projected out of the surface of fabric. Two feeders which travel different orbits on a needle bed are used, a yarn on the front yarn feeder is fed to a needle of the back bed while a yarn on back yarn feeder is fed to a needle of front bed so that the yarns on both the yarn feeders are intertwined with each other to form a loop of fabric, and the formed loop is transferred to the needle adjacent thereto to overlap the loop to integrally connect the fabric.

4 Claims, 42 Drawing Sheets

MOVE OF FEEDER FB
21
22
23
A B C D E F G H I
B
F
FRONT FABRIC MISS (REST)
FRONT FABRIC FRONT STITCH KNIT
FRONT-FRONT FABRIC FRONT STITCH OVERLAP
FEEDER F
LOOP OF FRONT BED IS TRANSFERRED TO NEEDLE OF BACK BED
LOOP OF BACK BED IS TRANSFERRED TO NEEDLE OF FRONT BED
BACK FABRIC MISS (REST)
BACK FABRIC FRONT STITCH KNIT
BACK-BACK FABRIC FRONT STITCH OVERLAP
FEEDER B

B F

B F

B F

B F

REPEAT 5 TIMES

REPEAT 5 TIMES

REPEAT 5 TIMES a b c d e f g h i
A B C D E F G H I
31
32
BU
BD
FD
FU

FRONT FABRIC MISS(REST)
FRONT FABRIC FRONT STITCH KNIT
FRONT-FRONT FABRIC FRONT STITCH OVERLAP
FEEDER F
LOOP OF FRONT BED IS TRANSFERRED TO NEEDLE OF BACK BED
LOOP OF BACK BED IS TRANSFERRED TO NEEDLE OF FRONT BED
BACK FABRIC MISS(REST)
BACK FABRIC FRONT STITCH KNIT
BACK-BACK FABRIC FRONT STITCH OVERLAP
FEEDER B

MOVE OF FEEDER FB
a b c d e f g h i
A B C D E F G H I
BU
BD
FD
FU

REPEAT 2 TIMES

REPEAT 2 TIMES

REPEAT 2 TIMES

REPEAT 2 TIMES

REPEAT 2 TIMES b
a
a b c d e f g h i
A B C D E F G H I
37
38
BU
BD
FD
FU

REPEAT 2 TIMES

REPEAT 5 TIMES

MOVE OF FEEDER B
1P
A B C D E F G H I
a b c d e f g h i
BU
BD
FD
FU

REPEAT 5 TIMES

REPEAT 5 TIMES

METHOD FOR PROCESSING END PORTION OF FABRIC

This is a continuation of application Ser. No. 07/730,552 filed on Jul. 16, 1991, now abandoned.

FIELD OF THE INVENTION

The present invention relates to a method for processing the end portion of fabric, in which a tubular fabric or a plurality of front and back fabrics knitted by at least two needle beds are finished to be knitted in a state in which they are connected at the end portion of the fabric.

RELATED ART STATEMENT

In a case in which clothing is prepared using fabrics knitted in a tubular form, the clothing is prepared by cutting the knitted fabric into an appropriate length according to one's stature, cutting a sleeve bored portion and a collar bored portion, integrating a shoulder line, and sewing the sleeve, collar, etc. onto the shoulder. In the case of a vest, etc., taping is applied to the shoulder.

However, in the aforementioned process, it takes much time to cut the sleeve bored portion, the collar bored portion, etc. Therefore, a procedure may be employed for knitting the fabric into a predetermined shape in advance, which procedure requires no cutting as just mentioned. However, even if this procedure is employed, it is still necessary to finally sew the shoulder portion.

For example, in making a vest, it is necessary for a sleeve bored portion and a collar bored portion knitted into a predetermined length by a circular knitting machine to be cut, a shoulder portion to be sewn, a waist band to be attached to the waist portion, and a tape to be attached to the sleeve bored portion by linking.

In view of the foregoing, the present applicant has invented a fabric and knitting method disclosed in Japanese Patent Laid-Open No. 2-91254 in an attempt to save labor over the conventional operating steps which require much time (as mentioned above) and to make products of high quality. In this method, a tubular fabric or a plurality of front and back fabrics according to the shape of the knitted fabric are integrated at the end portion at the completion of knitting, and anti-raveling is applied to the end portion at the completion of knitting. Loops of the final courses of both fabrics are engaged in needles of a front bed and a back bed and are transferred to one of the beds opposed to each other to overlap and integrate the loops, after which loops are sequentially formed and the loops are moved to overlap the loops to prevent raveling. Therefore, there is obtained a finish such that the joined portion of the fabrics projects out of the surface of the fabric.

OBJECT AND SUMMARY OF THE INVENTION

The present invention has been achieved in view of the foregoing. An object of the present invention is to provide a processing method in which, at an end portion at the completion of knitting fabric which is knitted by a flat knitting machine into a tubular fabric or a plurality of front and back fabrics according to the shape of knitted fabric, the integration of fabrics and the anti-raveling of the end portion at the completion of knitting are carried out and the joined portion does not project out of the surface of the fabric, thereby preventing the beauty from being harmed, as encountered in the prior art.

For solving the aforesaid problem, according to the present invention, there is provided a method comprising using a flat knitting machine provided with a front bed and a back bed arranged so that the head portions thereof are opposed to each other, using two yarn feeders which travel in different orbits on a needle bed with respect to a needle of the front bed which holds a final course of fabric and a needle of the back bed which holds a final course of fabric, feeding a yarn on the yarn feeder positioned on this side to the needle of the back bed and a yarn on the yarn feeder positioned on the back side to the needle of the front bed so that the yarns on both the yarn feeders are intertwined with each other to form a loop of fabric continuous with the final course, transferring the formed loop to the needle adjacent thereto to overlap the loop to integrally connect the fabric, and repeatedly executing the step of applying the anti-raveling a predetermined number of times with respect to successive needles.

BRIEF DESCRIPTION OF THE DRAWINGS

FIGS. 3-1 to 3-19 show knitting according to Embodiment 1 showing the steps of knitting by a 2-bed flat knitting machine;

FIGS. 4-1 to 4-19 show knitting according to Embodiment 1 showing the steps of knitting by a 4-bed flat knitting machine;

FIG. 5 is a loop view of fabric according to Embodiment 2;

FIGS. 6-1 to 6-22 show knitting according to Embodiment 2 showing the steps of knitting by a 4-bed flat knitting machine;

FIG. 7 is a loop view of fabric according to Embodiment 3;

FIGS. 8-1 to 8-18 show knitting according to Embodiment 3 showing the steps of knitting by a 4-bed flat knitting machine; and FIGS. 9 to 11 are respectively loop views showing fabrics according to other embodiments knitted by a method in accordance with the present invention.

DETAILED DESCRIPTION OF PREFERRED EMBODIMENT

Figure 1:
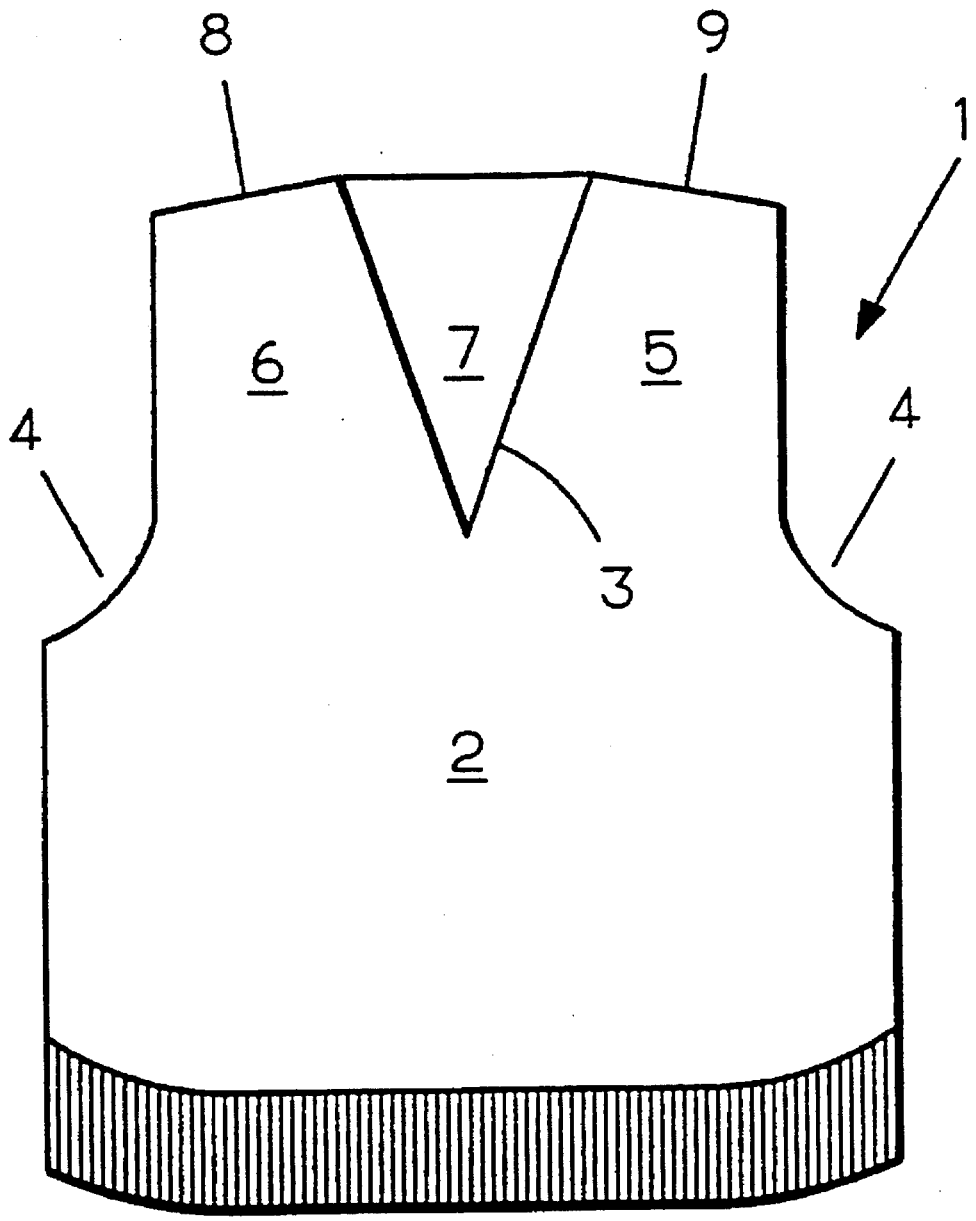
FIG. 1 is a front view of a vest knitted by a method in accordance with the present invention.

An embodiment will be described with reference to the drawings, in which a knitting method of the present invention is used to knit a vest 1 shown in FIG. 1.

The knitting method of the present invention can be worked by either a so-called 2-bed flat knitting machine (in which two beds are provided, one for the front and the other for the back), or a so-called 4-bed flat knitting machine (in which four beds are provided, two for the front and two for the back). For convenience of explanation, in Embodiment 1 the steps of knitting by the knitting machine are explained with reference to knitting drawings. In Embodiments 2 and 3, only knitting by use of a 4-bed flat knitting machine will be described.

On the flat knitting machine is mounted a carriage having a knitting lock and a transfer lock (not shown). Upwardly of the needle bed, a plurality of rails for a yarn running area are provided parallel to the length of the needle bed. Each rail has a yarn feeder for feeding yarn to the needles. With respect to the needle beds, in a 2-bed flat knitting machine, a front bed F having needles A to I and a back bed B having needles A to I are provided opposite each other. In a 4-bed flat knitting machine, a lower front bed FD and a lower back bed BD having needles A to I and an upper front bed FU and a lower back bed BU having needles a to i are provided opposite each other.

In knitting a vest 1, first, the body portion 2 is knitted into a tubular shape. At a collar bored portion 3 and a sleeve bored portion 4, the left and right body parts 5 and 6 and the back body part 7 are principally knitted by the front bed and the back bed, respectively. (In FIG. 1 the left front body part 5 is shown on the right side and the right front body part 6 is shown on the left side.) When the knitting of the left and right body parts 5, 6 and the back body part 7 is finished, the anti-raveling of the end portion at the completion of knitting of both the front and back body parts and the integration of the fabrics are done at the shoulder lines 8 and 9 to complete knitting.

In these embodiments, a yarn feeder (hereinafter called a feeder F) mounted with its front side toward the knitting machine feeds a yarn to a needle of the front bed to knit the front body part. A yarn feeder (hereinafter called a feeder B) positioned at the rear of the first mentioned yarn feeder feeds a yarn to a needle of the back bed to knit the back body part. In the anti-raveling of the end portion at the completion of knitting to be followed, the feeders F and B are exchanged. That is, the yarn of the feeder F is supplied to the needle of the back bed, and the yarn of the feeder B is supplied to the needle of the front bed to effect knitting.

The processing of the shoulder lines 8 and 9 is carried out symmetrically to the left and to the right by a similar method. Only the shoulder line 8 will be explained with reference to the drawings. In the later described embodiments, a description of the knitting of the body portion 2, the collar bored portion 3, the sleeve bored portion 4 and the left and right body parts 5 and 6 of the vest 1 has been omitted. The method for processing the shoulder line 8 after the final course, which constitutes a main part of the present invention, will be explained with reference to the knitting views and the loop views. Only the loops and the number of needles, etc. necessary for explanation are shown in the drawings, and others are not shown.

EMBODIMENT 1

Figure 2:
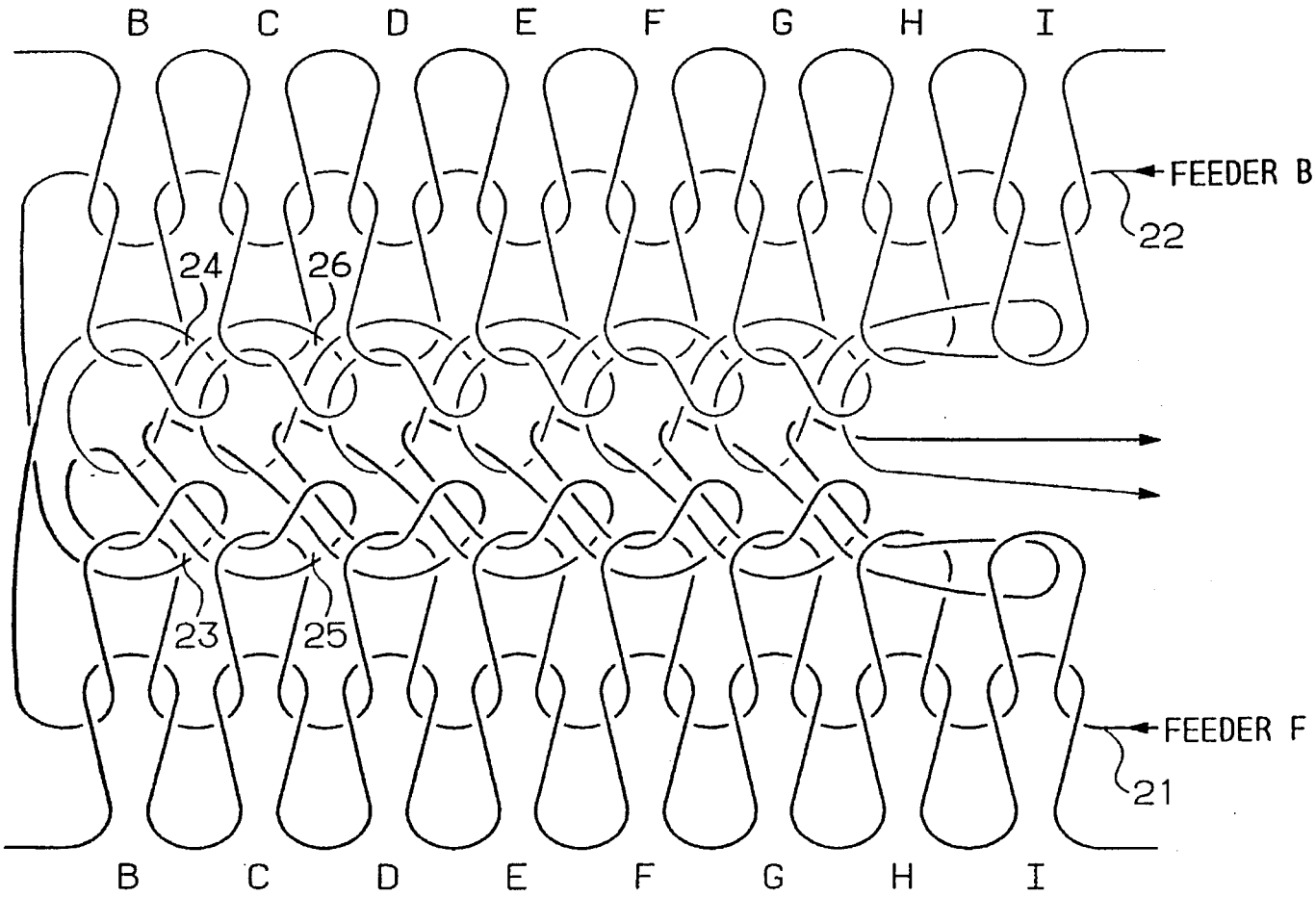
FIG. 2 is a loop view of fabric according to Embodiment 1.

FIG. 2 is a loop view showing the state in which a portion in the midst of knitting the shoulder line 8 of the vest 1 is developed.

First, the present embodiment will be described with reference to the knitting view by way of the 2-bed flat knitting machine shown in FIG. 3.

Figures 1, 2, 3, 4:
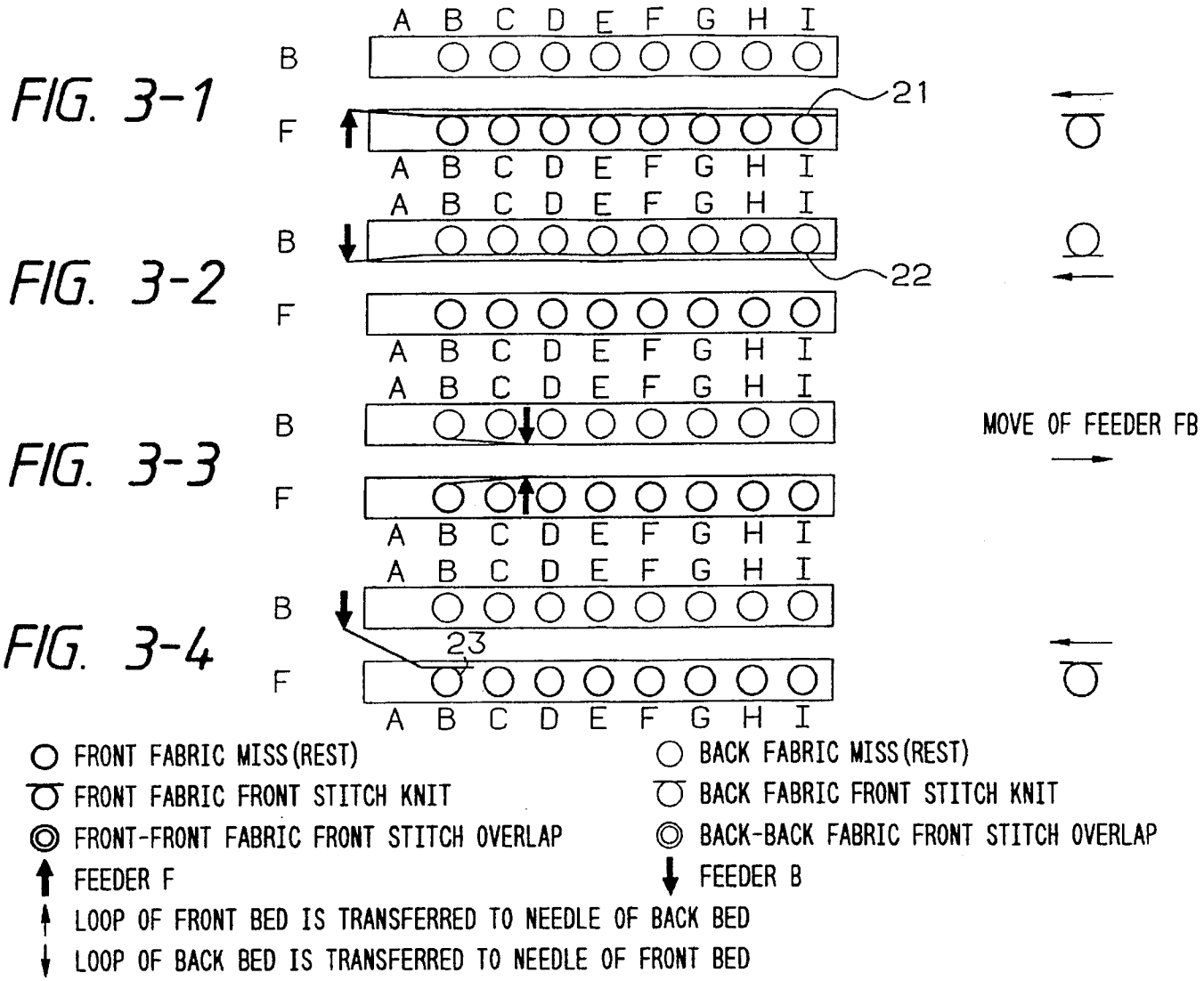

In FIG. 3-1, yarns are fed by the feeder F to the needles I, H, . . . C, B of the front bed to form a final course 21 of the front body part.

In FIG. 3-2, yarns are fed by the feeder B to the needles I, H, . . . , C, B of the back bed to form a final course 22 of the back body part.

In FIG. 3-3, the formation of loops is not carried out, but the movement of both feeders F and B is carried out.

In FIG. 3-4, a yarn is fed by the feeder B to the needle B of the front bed to form a loop 23. The loop 23 is transferred to the needle A of the back bed (see FIG. 3-5), and transferred again to the needle C of the front bed (see FIG. 3-6) which holds the loop of the final course to form an overlap stitch (FIG. 3-6). Subsequently, the feeder B is moved rightward (FIG. 3-7).

In FIG. 3-8, a yarn is fed by the feeder F to the needle B of the back bed to form a loop 24. The yarn delivered from the feeder F at that time crosses the yarn of the feeder B which extends to the needle C, as shown in FIG. 3-8. Thereafter, the loop 24 is transferred to the needle B of the front bed (FIG. 3-9), after which the loop 24 is transferred to the needle C of the back bed (FIG. 3-10) which holds the loop of the final course to form an overlap stitch. The feeder F is then moved rightward, and the yarn of the feeder F crosses the yarn of the feeder B (FIG. 3-11).

Next, a yarn is fed to the needle C of the front bed while winding the yarn in the crossed state of the feeder F by the feeder B, to form a loop 25 (FIG. 3-12). The loop 25 is transferred to the needle B of the back bed, after which it is transferred to the needle D of the front bed which holds the loop of the final course to form a stitch knit (FIGS. 3-13 and 14).

Next, the feeder B is moved rightward to cross the yarn of the feeder F (FIG. 3-15). In FIG. 3-16, a yarn is fed to the needle C of the back bed while winding the yarn in the crossed state of the feeder B by the feeder F, to form a loop 26. The thus formed loop 26 is transferred to the needle C of the front bed, after which it is transferred to the needle D of the back bed which holds the loop of the final course to form a stitch knit (FIGS. 3-17 and 18).

Thereafter, the knitting technique shown in the aforementioned FIGS. 3-11 to 3-18 is repeatedly applied to successive needles, and the loops of fabric engaged in the needles of the front bed and the back bed are connected in an intertwined state, and the loops engaged in the needle bed are successively reduced while applying the anti-raveling processing. In the case of the present embodiment, processing to the final needles I, I is carried out by repeating the steps shown in FIGS. 3-11 to 3-18 five times. Though not shown, the anti-raveling is applied to terminate knitting by a well-known method such as continuous knitting of some course after the loops held on the final needles I, I have been overlapped.

FIG. 4 shows a knitting view by way of a 4-bed flat knitting machine. Since knitting formation is substantially similar to that of the 2-bed flat knitting machine and will be understood by referring to the steps shown in FIGS. 4-1 to 4-19. FIGS. 4-1 to 4-19 correspond to FIGS. 3-1 to 3-19, respectively, and the knitting in the respective steps seems to be readily understood, explanation of which is therefore omitted.

EMBODIMENT 2

Figures 3, 4, 5, 6, 7, 8:
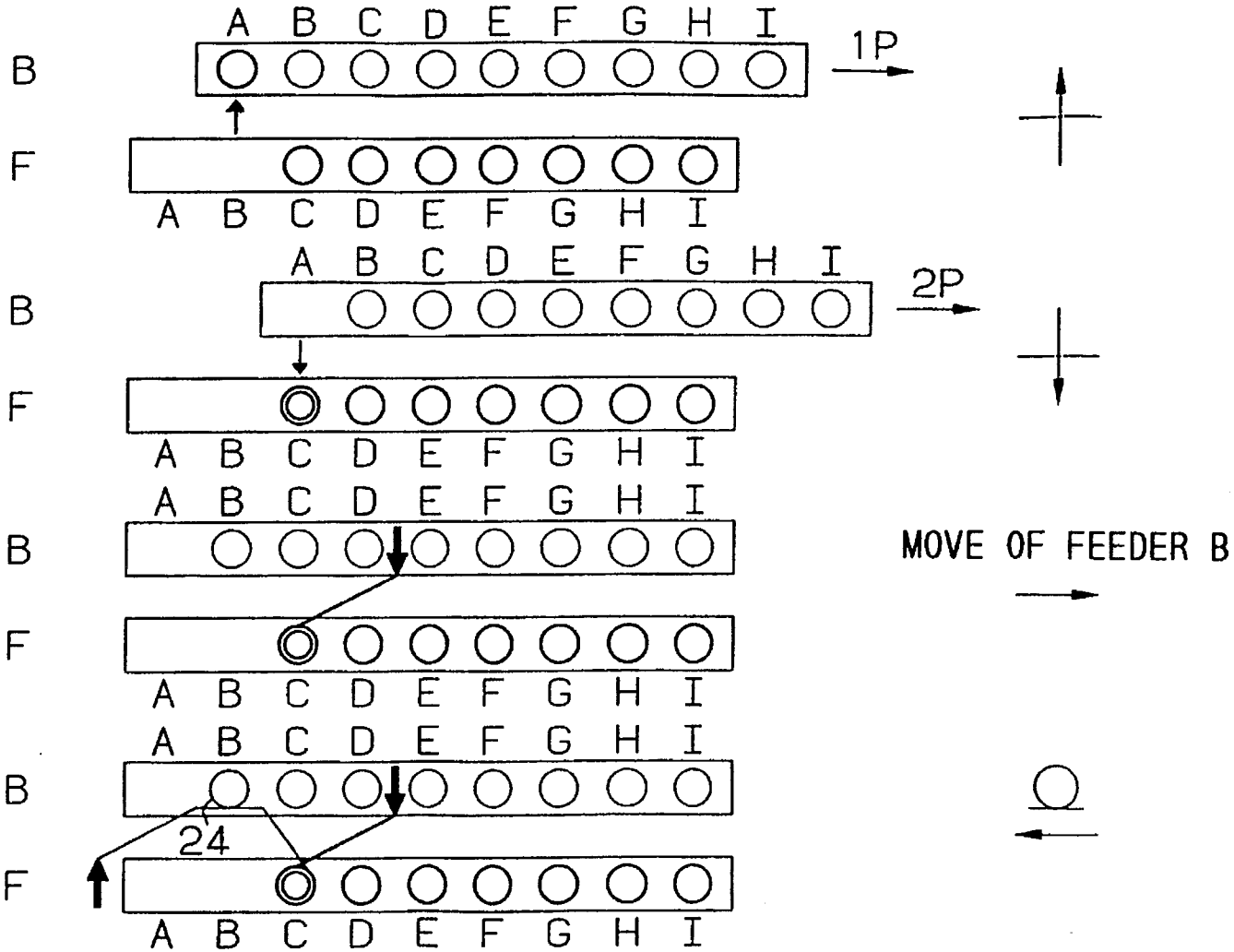

FIG. 5 is a loop view showing the state in which a portion in the midst of knitting the shoulder line 8 of the vest 1 is developed. 5

In FIG. 6-1, yarns are fed by the feeder F to needles I, H, . . . C, B of the front bed FD to form a final course 31 of the front body part. Then, in FIG. 6-2, yarns are fed by the feeder B to needles I, H, . . . C, B of the back bed BD to form a final course 32 of the back body part. In FIG. 6-3, a yarn is fed by the feeder B to the needle B of the front bed FD to form a loop 33. In FIG. 6-4, a yarn is fed by the feeder F to the needle B of the back bed BD to form a loop 34. As shown in FIG. 6-5, the feeders F and B are moved so that the feeder B crosses above the feeder F at the lefthand of fabric. The loop 33 held on the needle B of the front bed in the aforementioned state is transferred to the needle b of the back bed BU, after which it is transferred to the needle C of the front bed FD for engaging the loop of the final course to form an overlap stitch (FIGS. 6-6 and 7). The loop 34 held on the needle B of the back bed BD is likewise transferred to the needle c of the front bed FU, after which it is transferred to the needle C of the back bed BD which holds the loop of the final course to form an overlap stitch (FIGS. 6-8 and 9). In FIG. 6-10, the yarn of the feeder F which crosses below the yarn of the feeder B as shown in FIG. 6-5 is fed to the needle C of the back bed BD while winding the yarn of the feeder B to form a loop 35. In FIG. 6-11, a yarn is fed by g the feeder B to the needle C of the front bed FD to form a loop 36. Thereafter, both the feeders F and B are moved so that they cross at the lefthand of fabric in the state as shown in FIG. 6-12. The loops 35 and 36 formed by the aforementioned knitting are moved to the needle D of the back bed BD which holds the loop of the final course and the needle D of the front bed FD, respectively, to form an overlap stitch (FIGS. 6-13 to 6-16). Next, in FIG. 6-17, the yarn of the feeder B which crosses below the yarn of the feeder F as shown in FIG. 6-12 is supplied to the needle D of the front bed FD while winding the yarn of the feeder F to form a loop 37. In FIG. 6-18, a yarn is fed to the needle D of the back bed BD by the feeder F to form a loop 38.

Thereafter, the knitting shown in FIGS. 6-5 to 6-18 is repeatedly applied to successive needles. In case of the present embodiment, such knitting as just mentioned above is repeated twice whereby loops can be formed on the needles H, H of the front bed FD and the back bed BD. The thus formed loops are moved to the needles I and I of the front bed FD and the back bed BD in the manner similar to that as described above to form an overlap stitch (FIGS. 6-19 to 6-22). Thereafter, the anti-raveling is applied by the method similar to that of the Example 1 though not shown to finish knitting.

EMBODIMENT 3

FIG. 7 is a loop view showing the state in which a portion in the midst of knitting the shoulder line 8 of the vest 1 is developed.

Figures 3, 4, 5, 6, 7, 8, 9, 10, 11, 12:
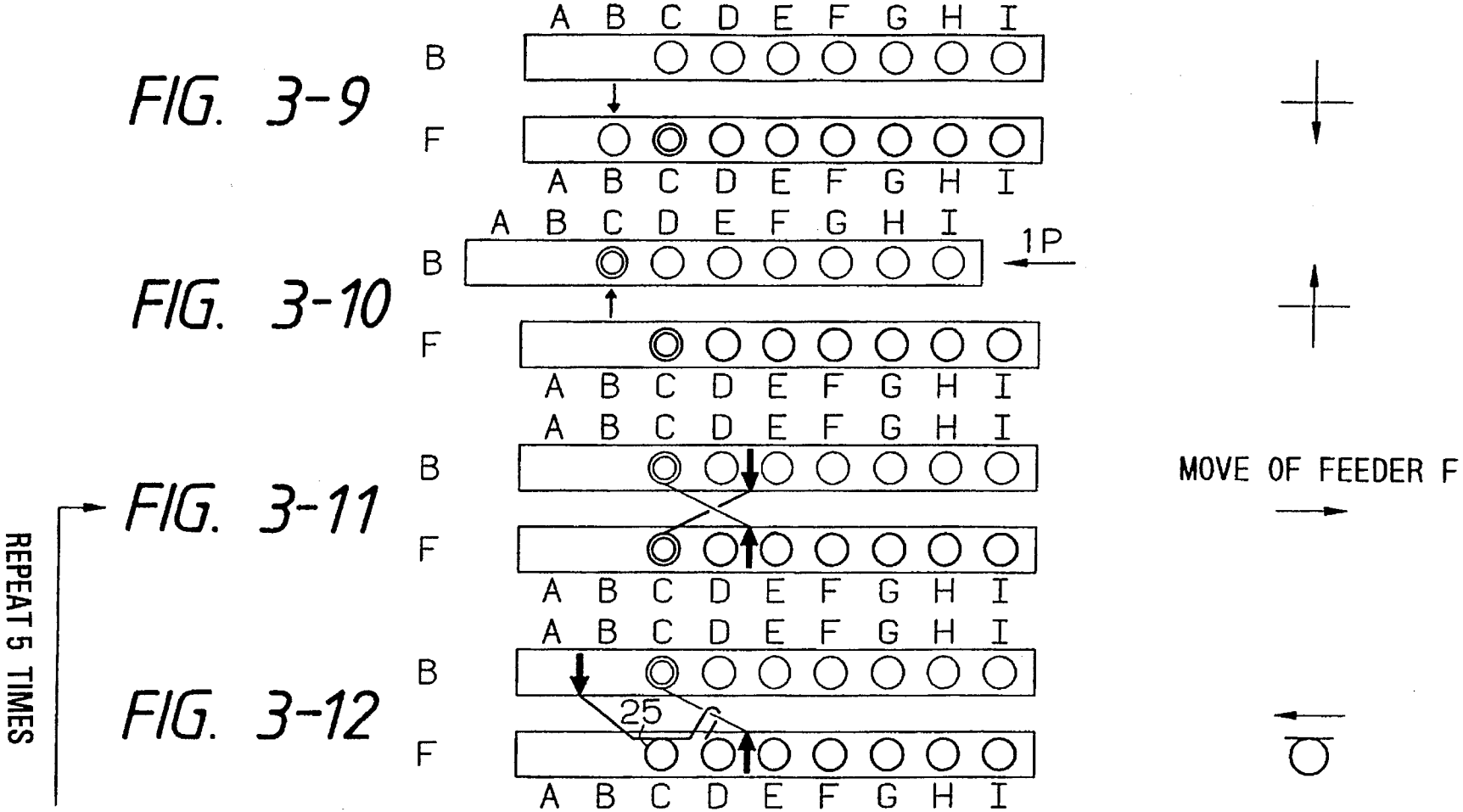
Figures 3, 4, 5, 6, 7, 8, 9, 10, 11, 12, 13, 14, 15, 16:
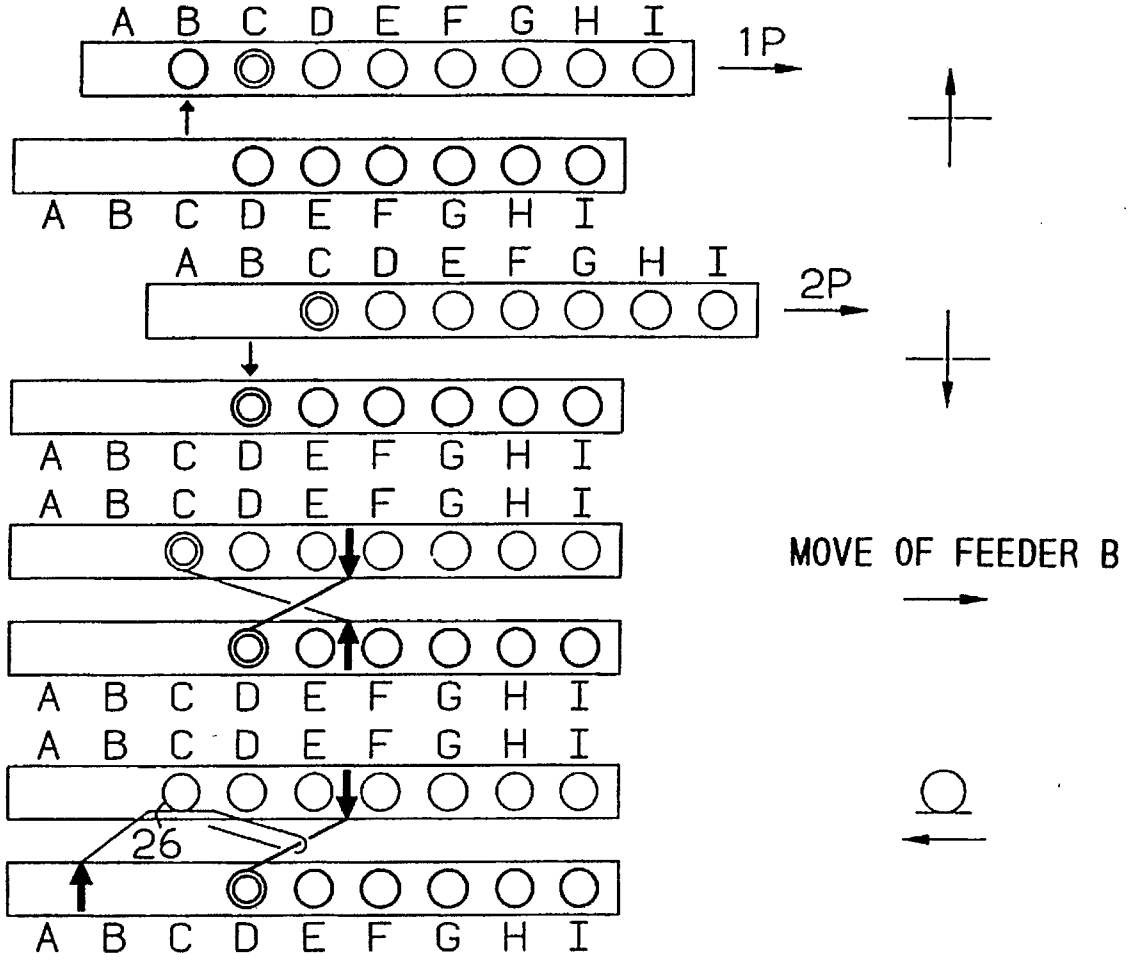
Figures 3, 4, 5, 6, 7, 8, 9, 10, 11, 12, 13, 14, 15, 16, 17, 18, 19:
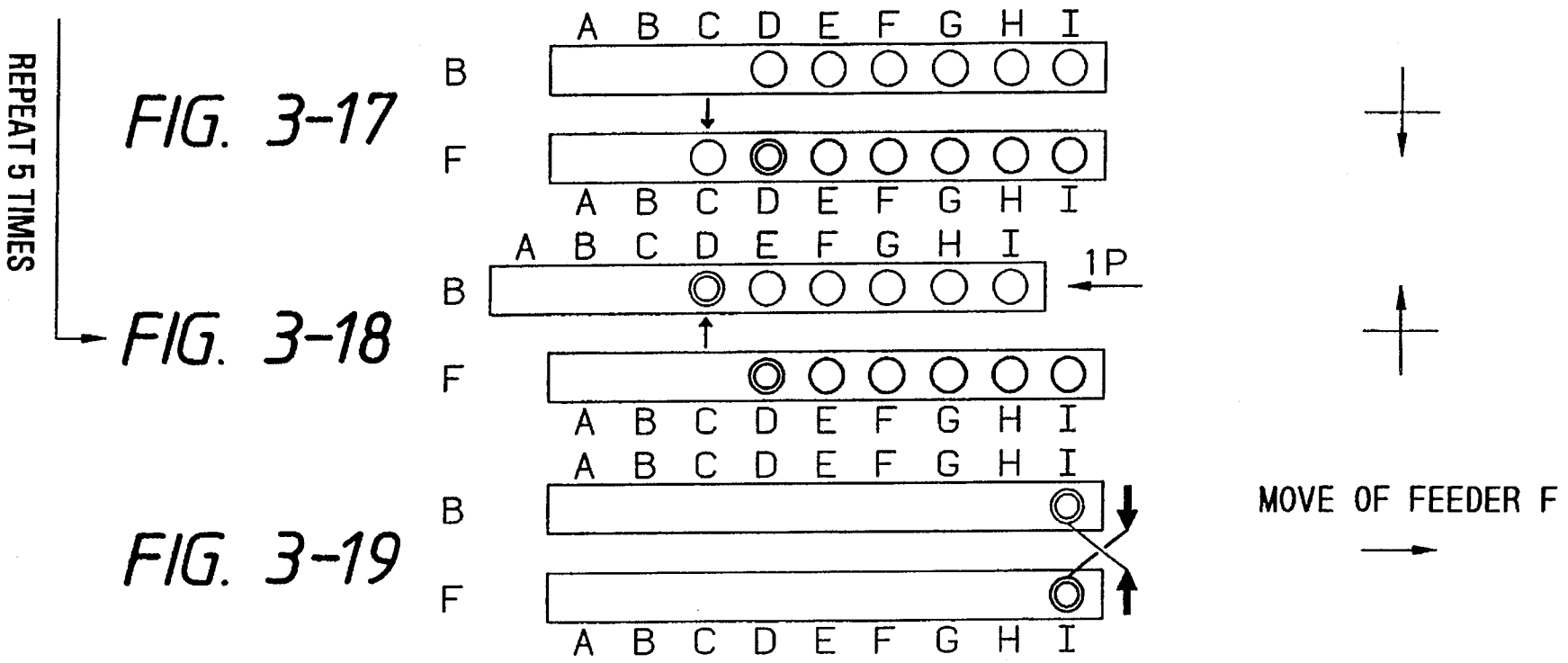
Figures 1, 2, 4:
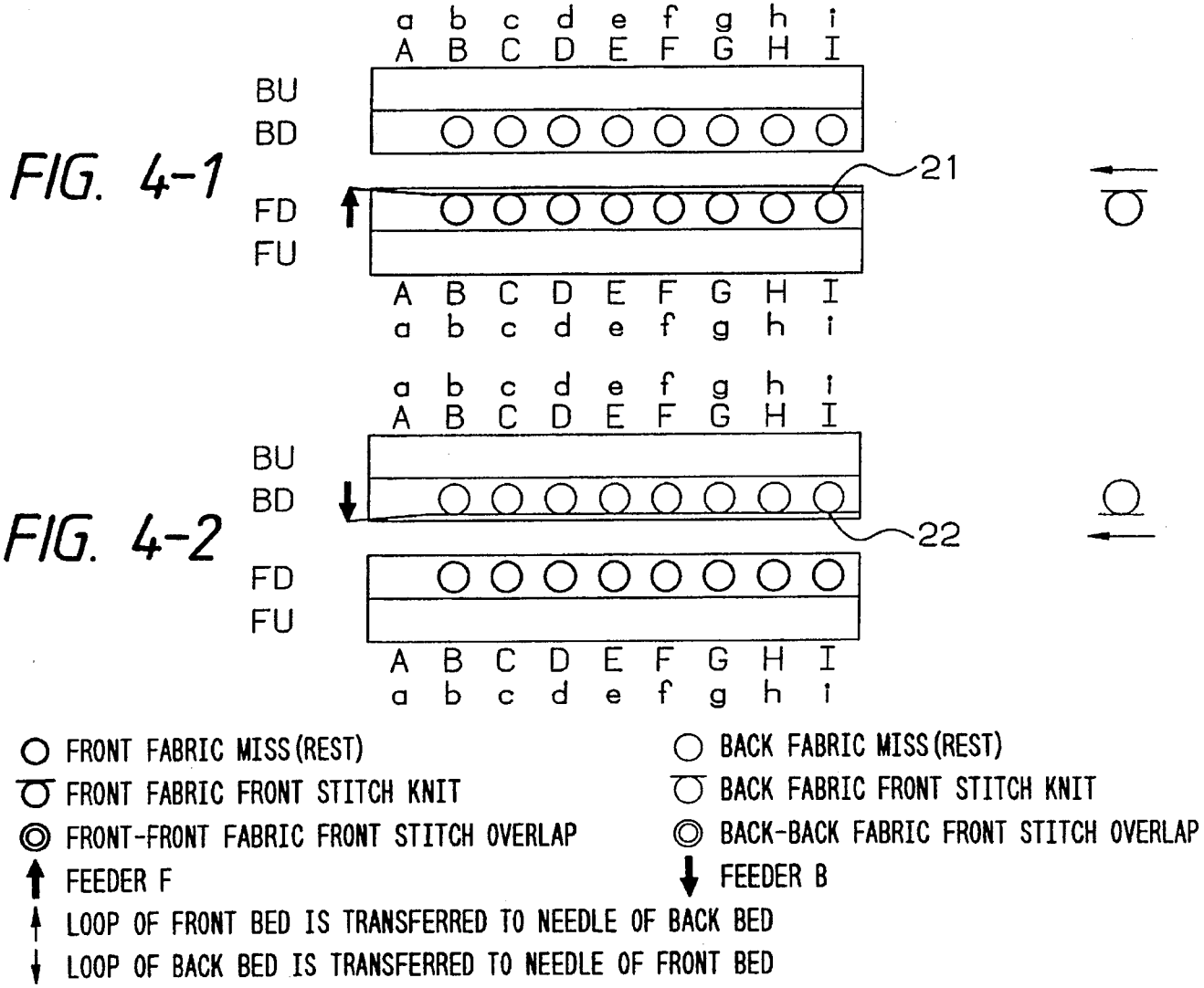
Figures 3, 4:
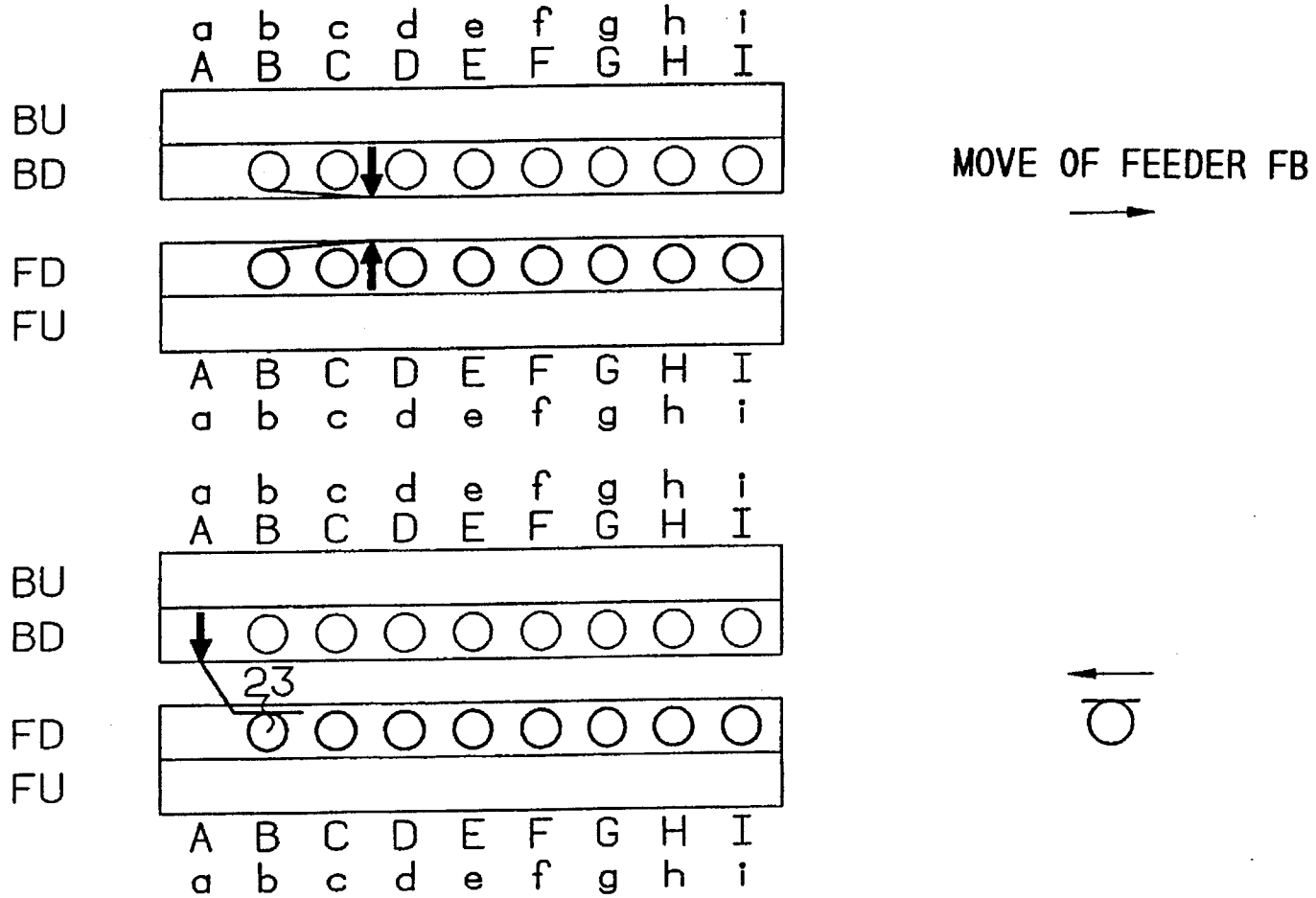
Figures 4, 5:
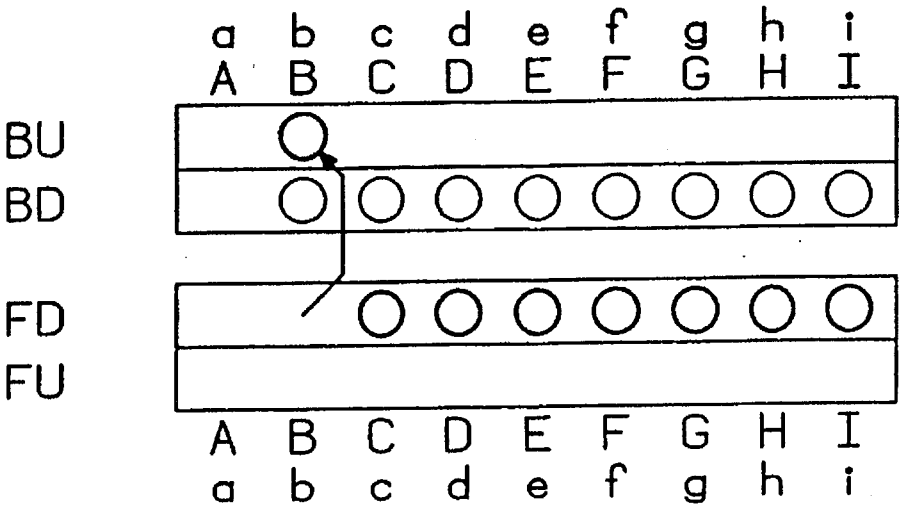
Figures 4, 5, 6:
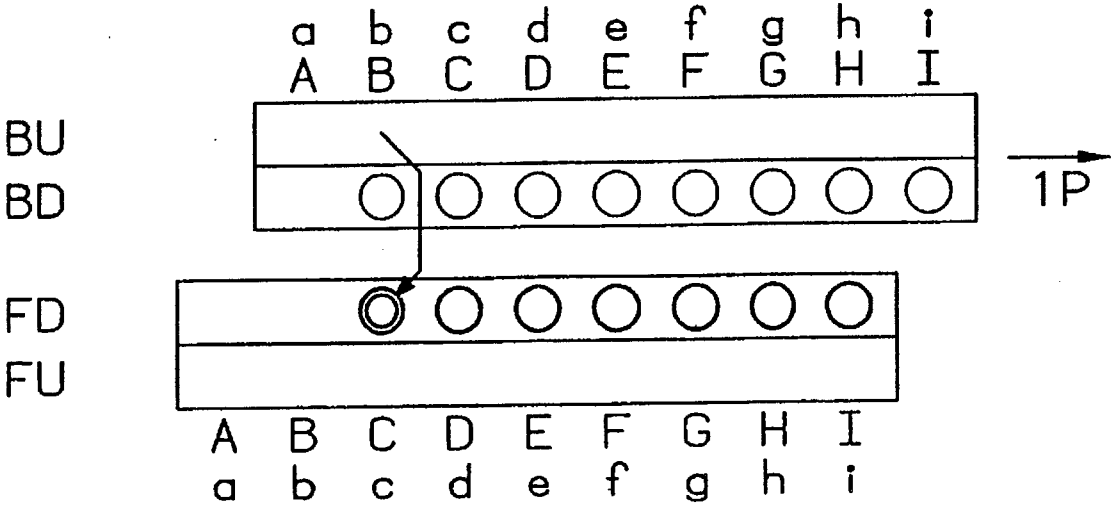
Figures 4, 5, 6, 7, 8:
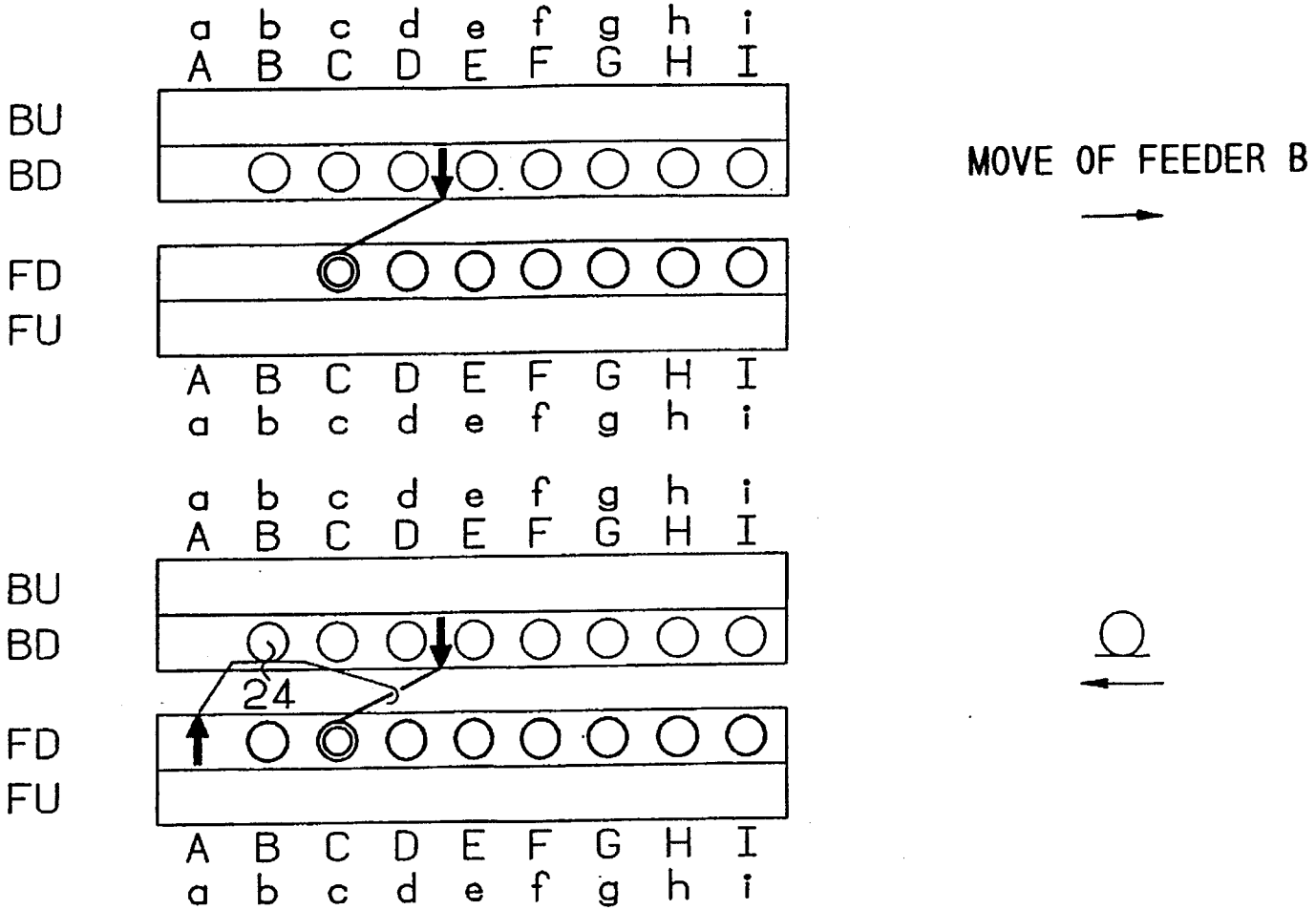
Figures 4, 5, 6, 7, 8, 9:
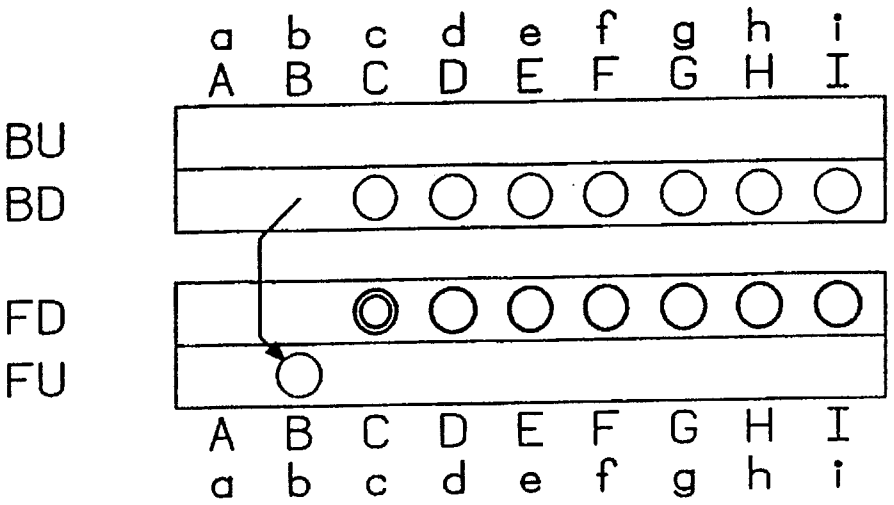
Figures 4, 5, 6, 7, 8, 9, 10:
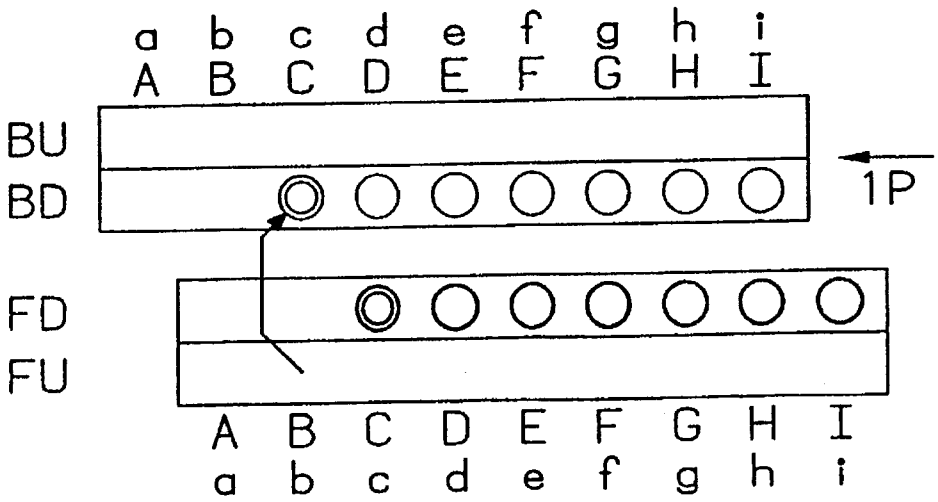
Figures 4, 5, 6, 7, 8, 9, 10, 11, 12:
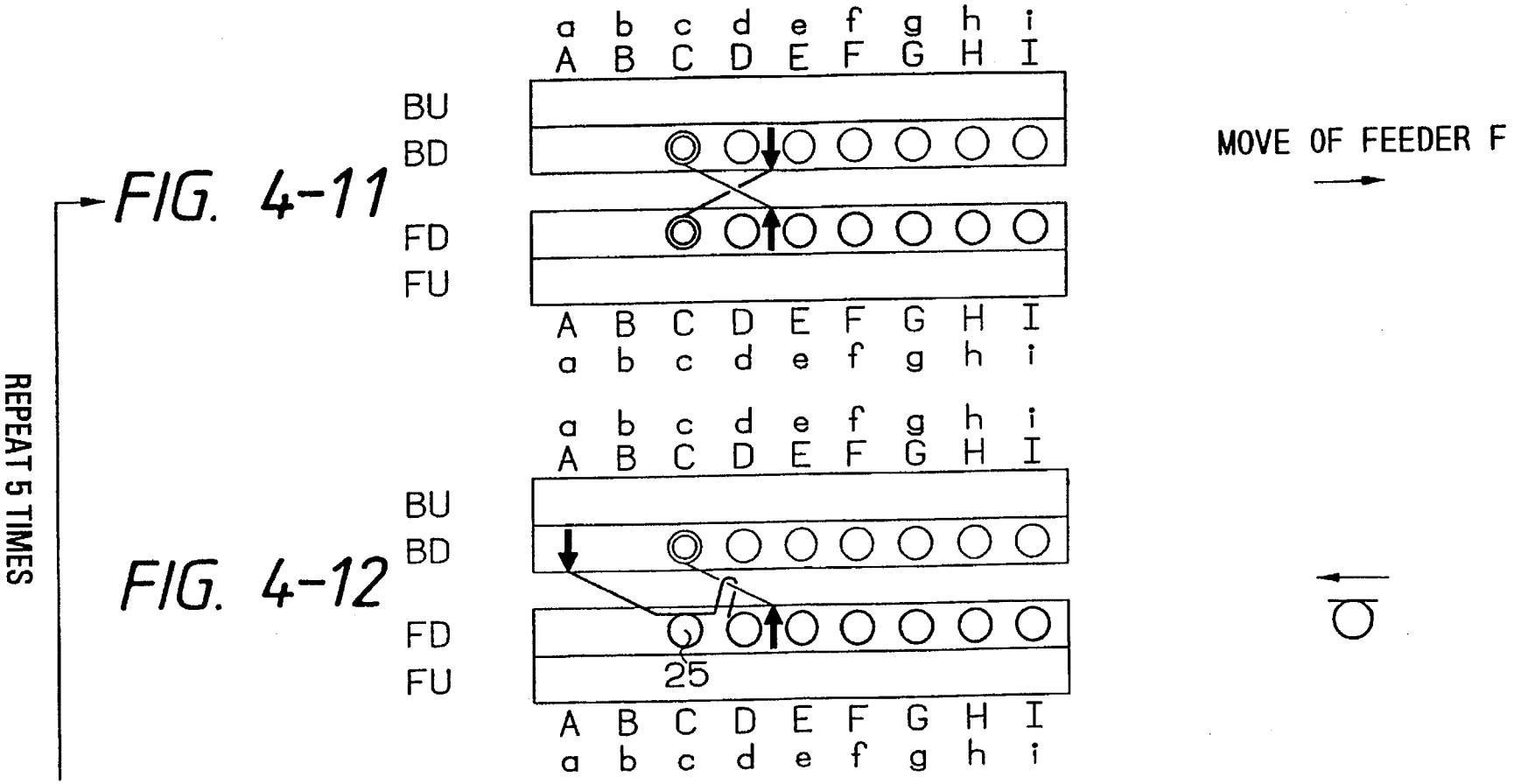
Figures 4, 5, 6, 7, 8, 9, 10, 11, 12, 13, 14:
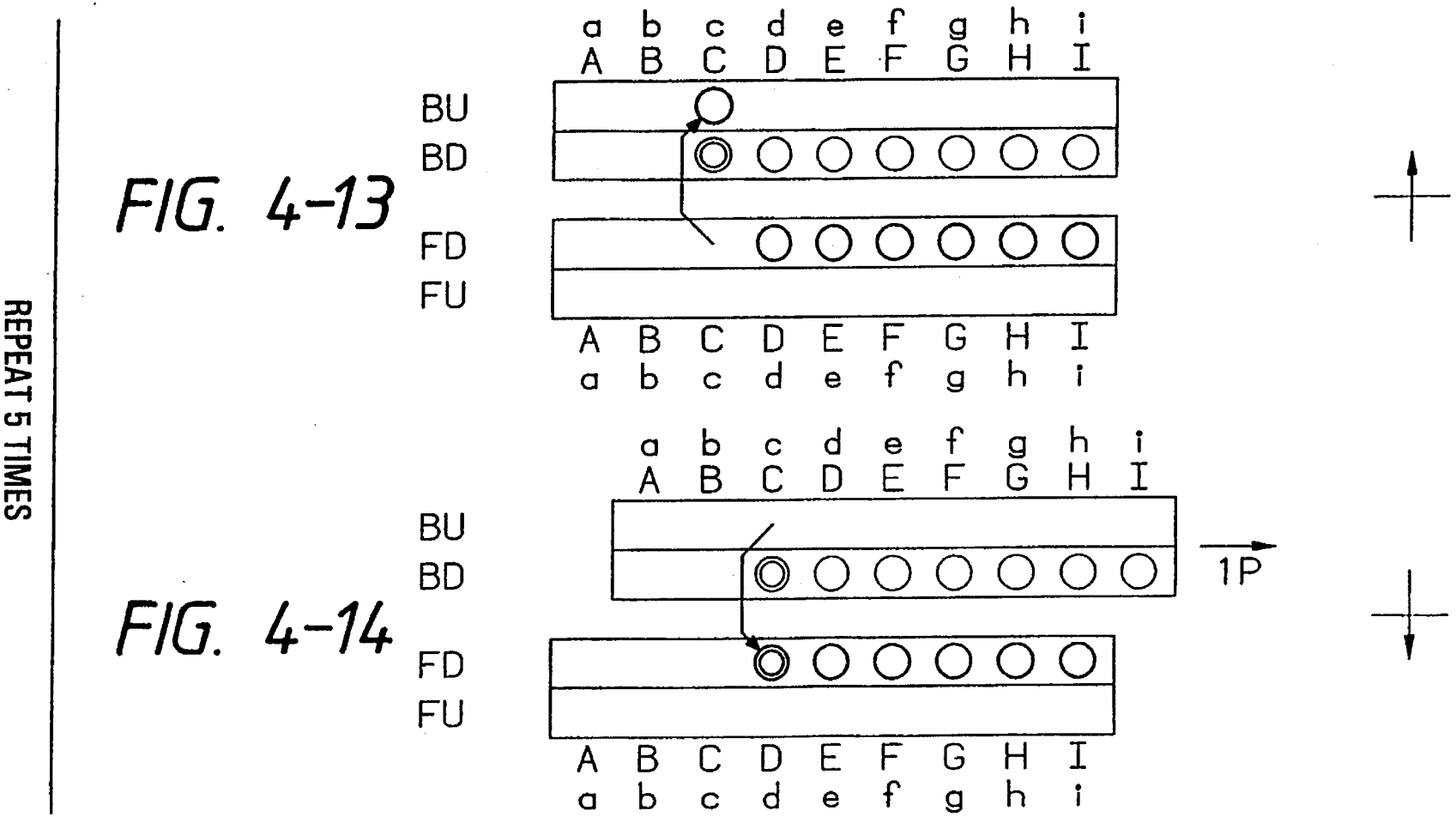
Figures 4, 5, 6, 7, 8, 9, 10, 11, 12, 13, 14, 15, 16:
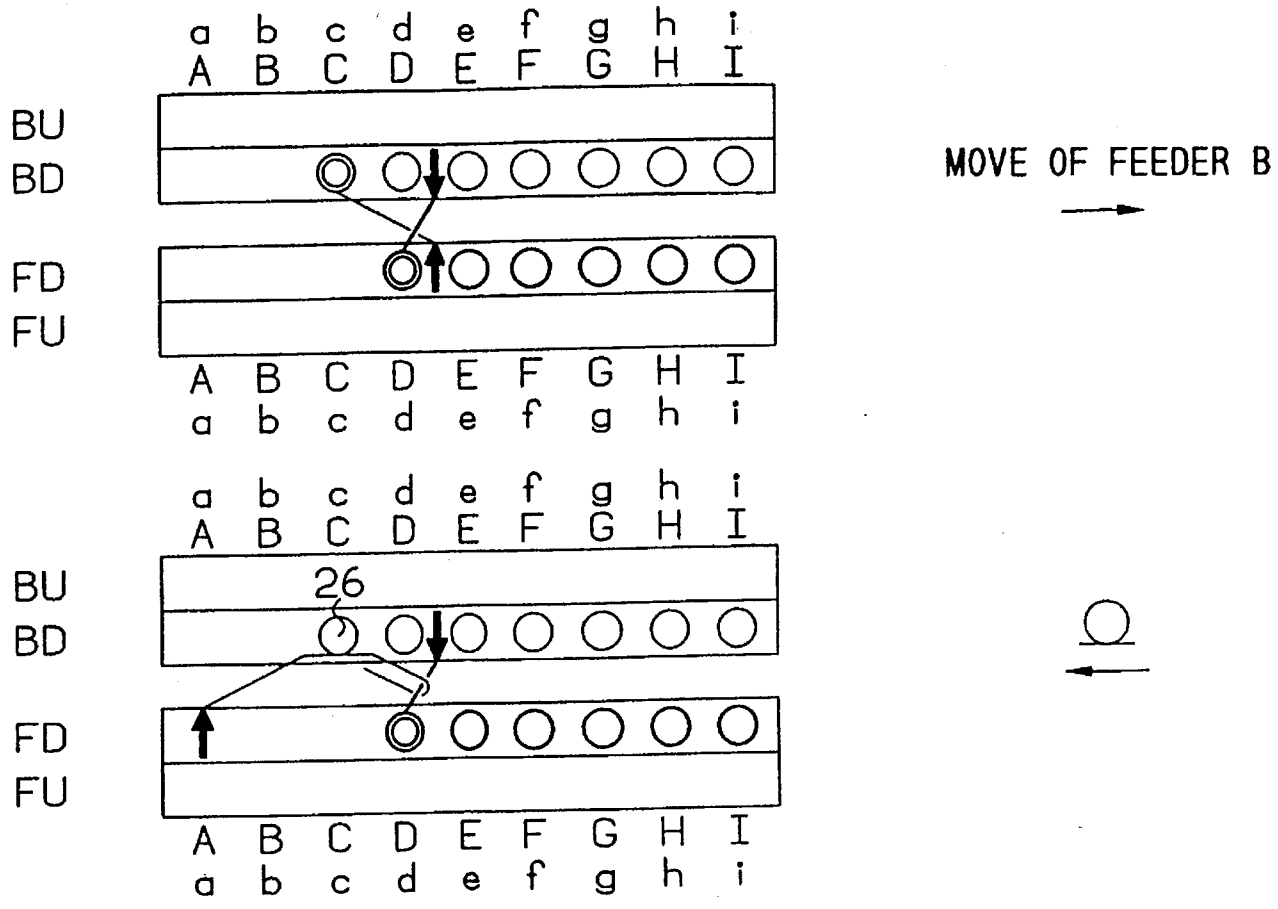
Figures 4, 5, 6, 7, 8, 9, 10, 11, 12, 13, 14, 15, 16, 17, 18:
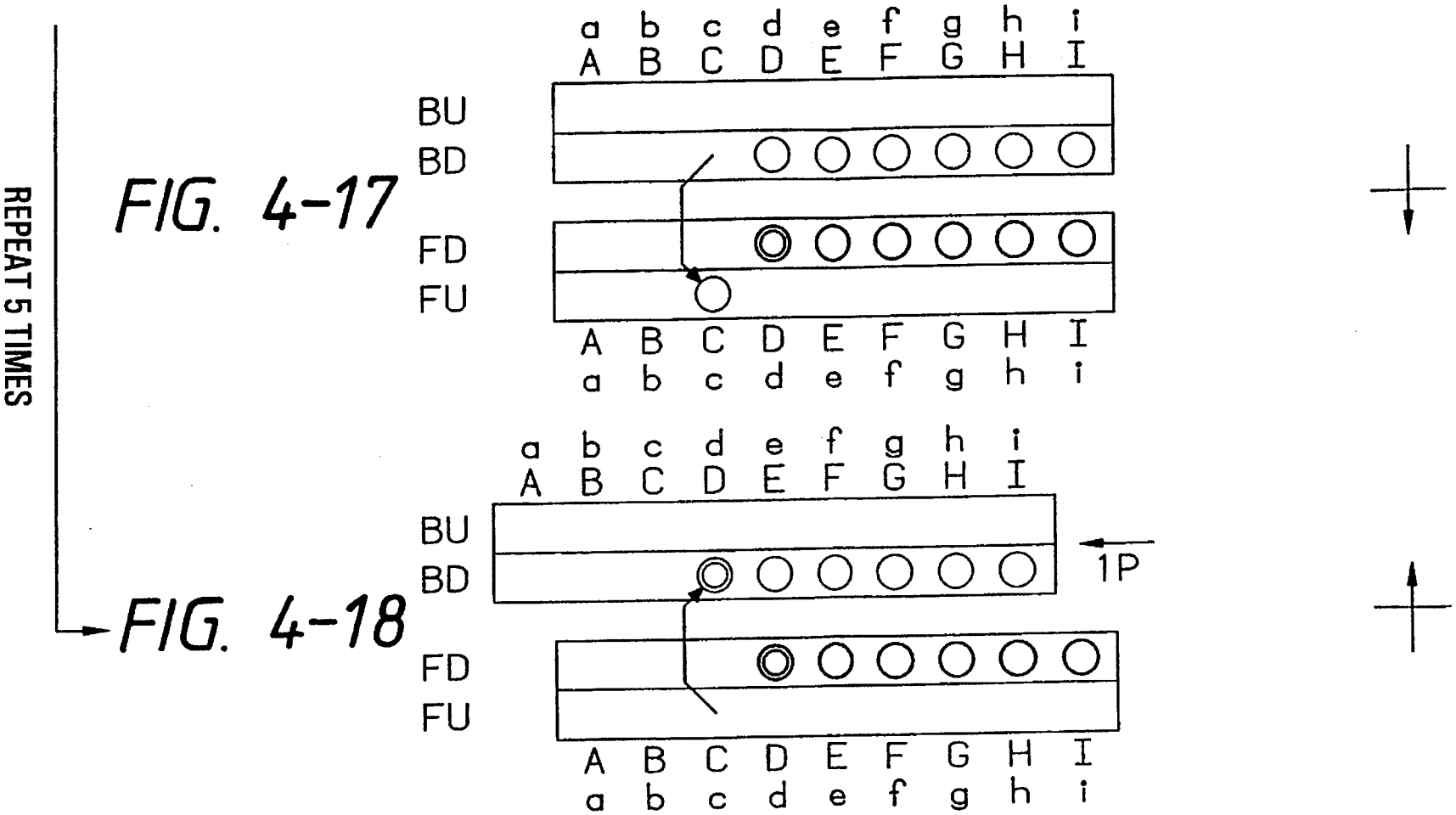
Figures 4, 5, 6, 7, 8, 9, 10, 11, 12, 13, 14, 15, 16, 17, 18, 19:
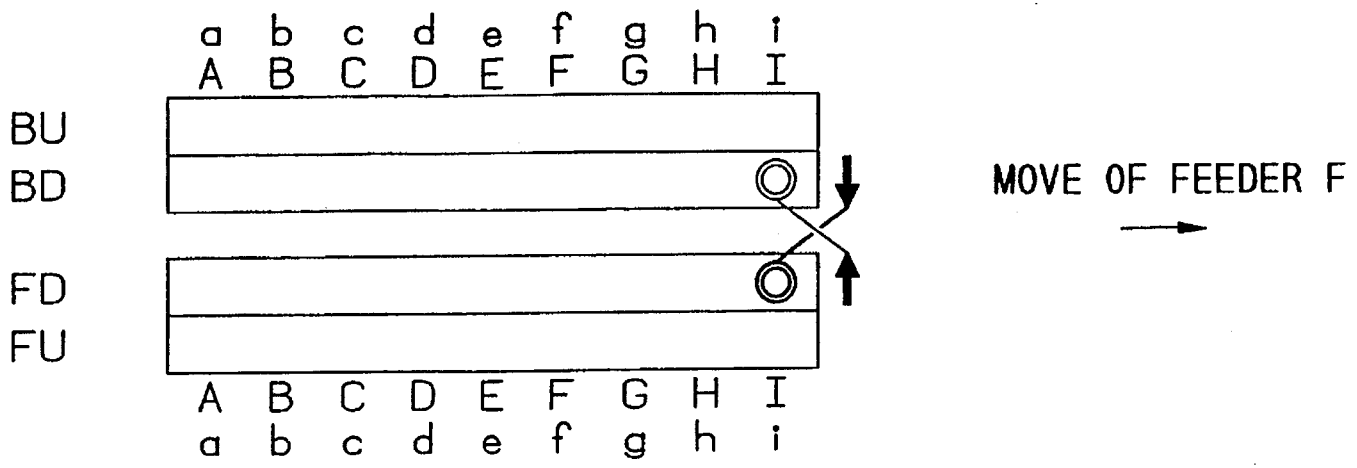
Figure 5:
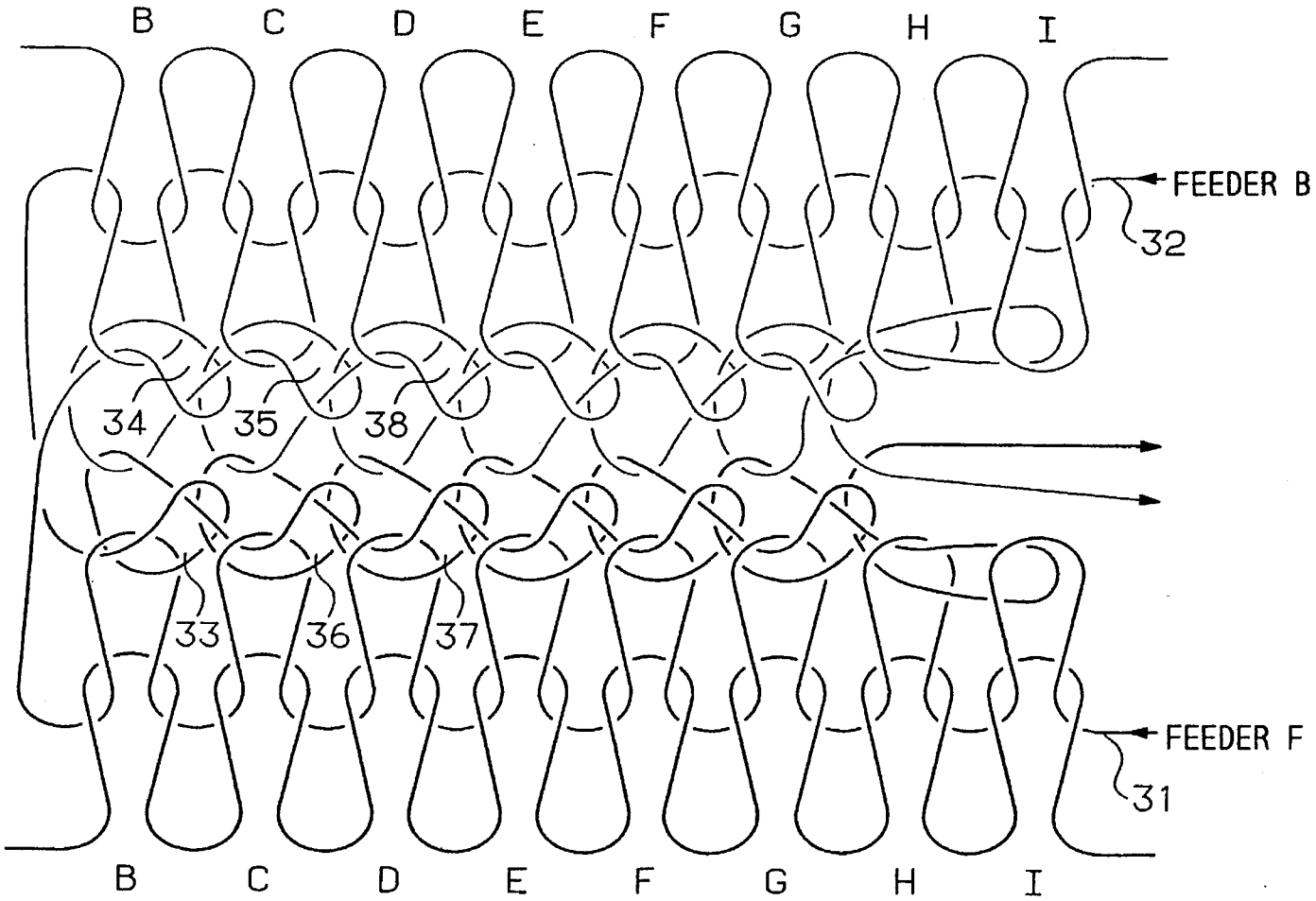
Figures 1, 2, 6:
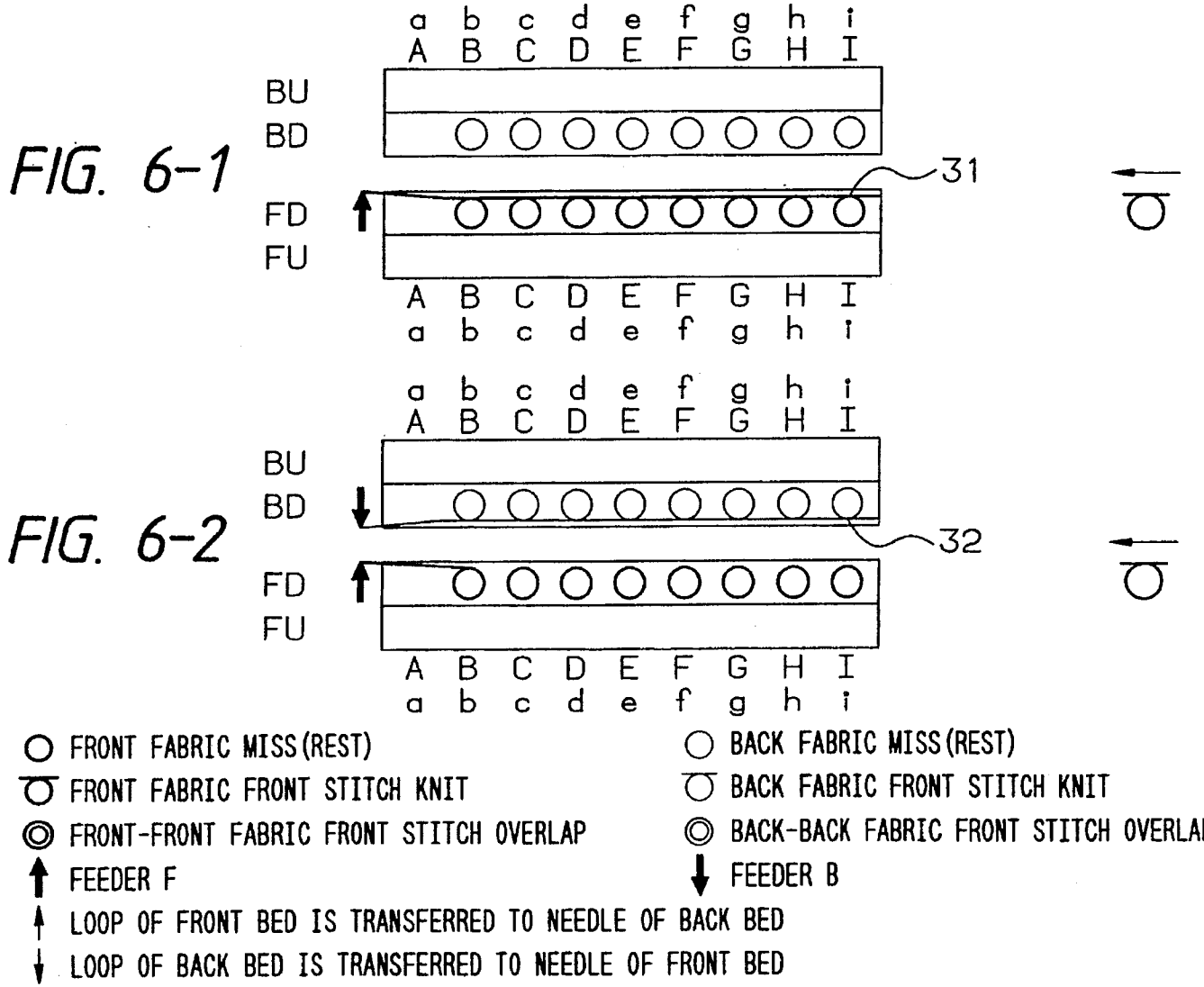
Figures 3, 4, 6:
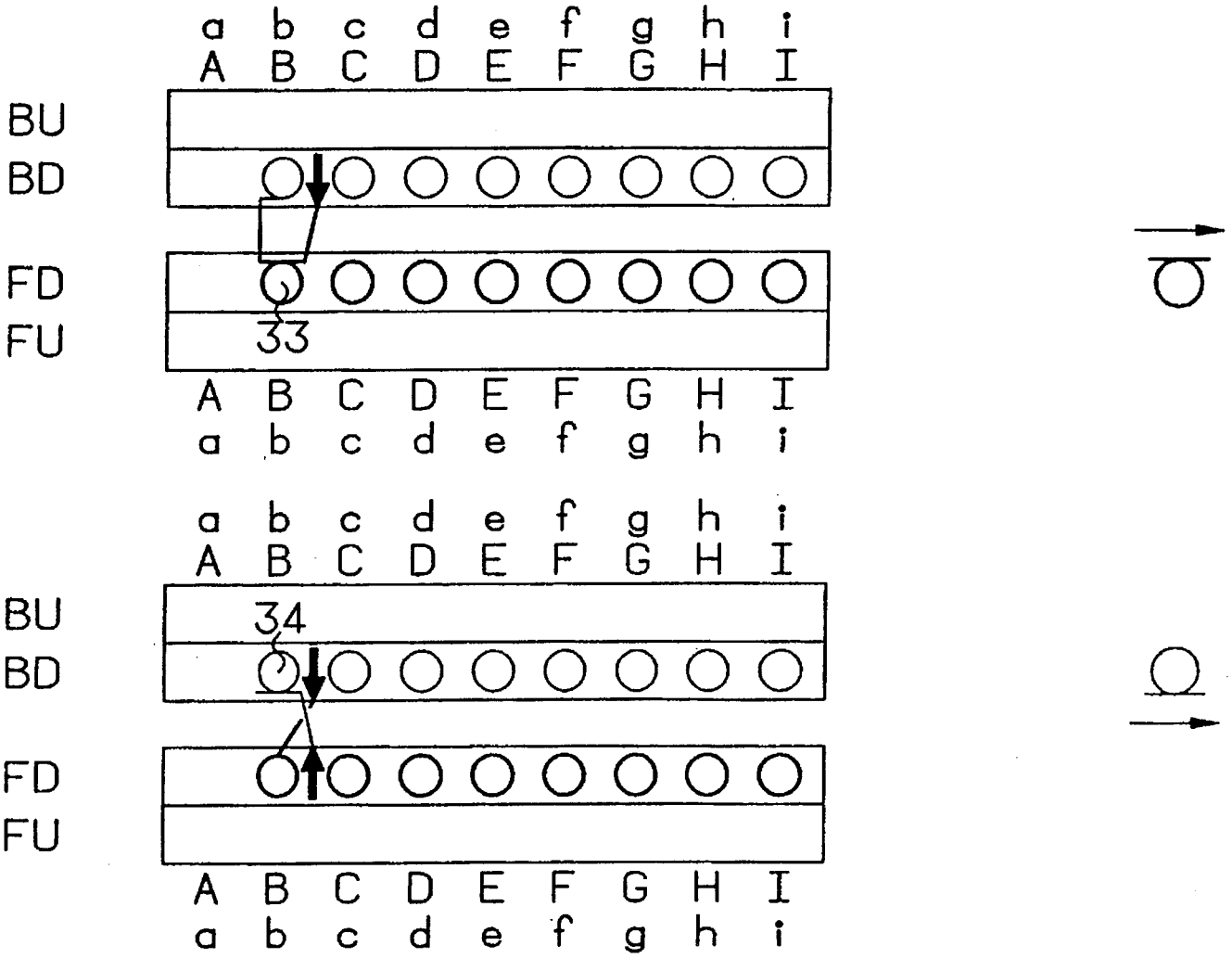
Figures 5, 6:
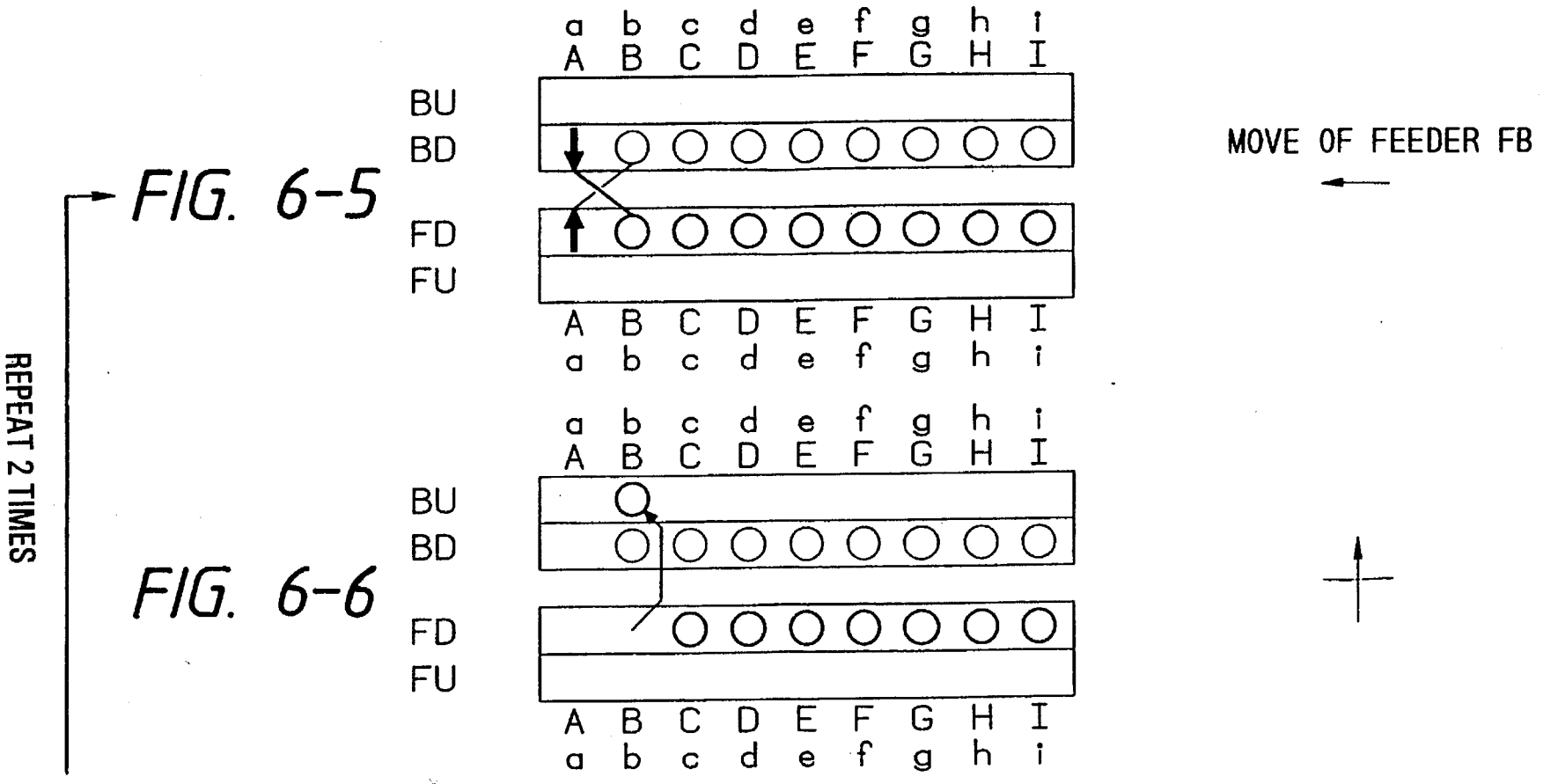
Figures 6, 7, 8:
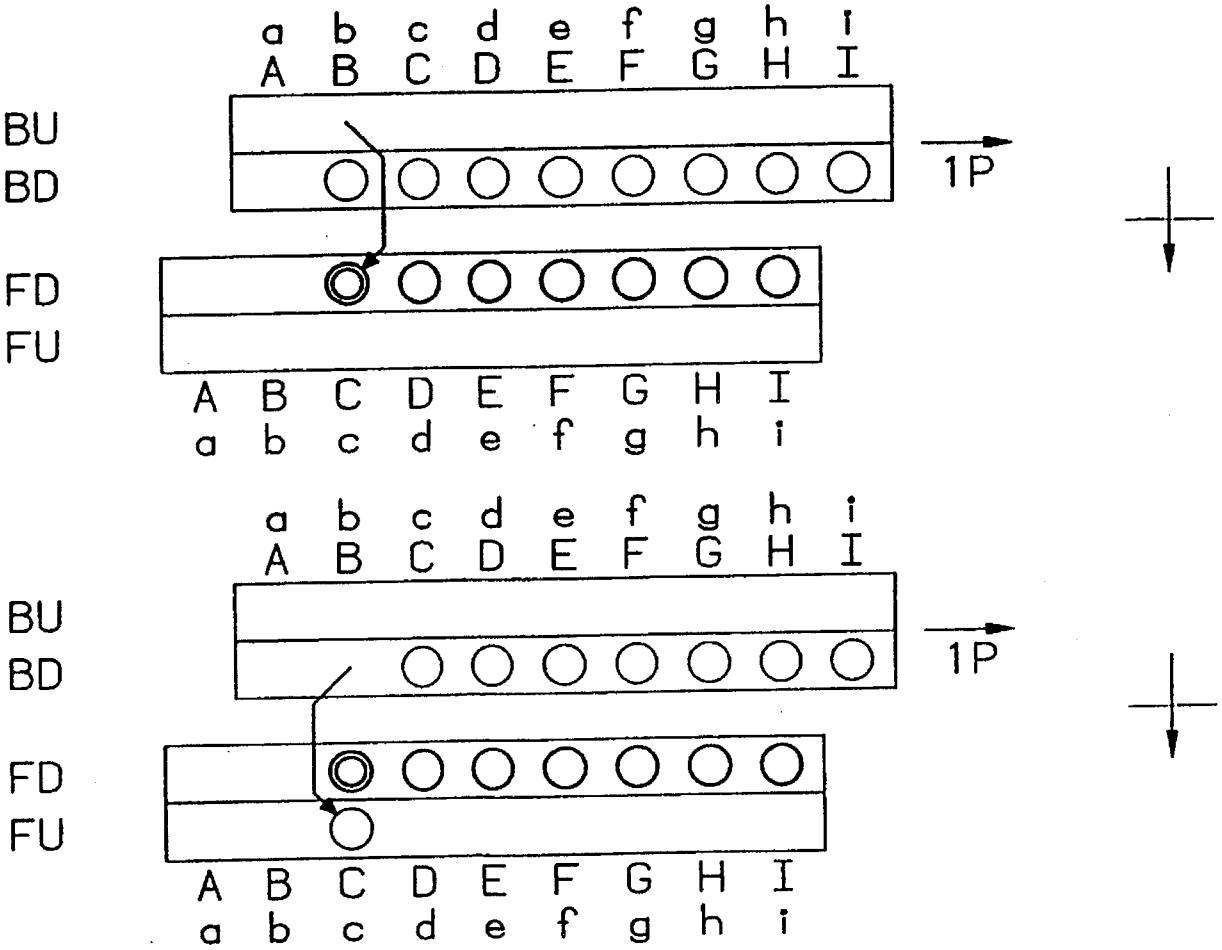
Figures 6, 7, 8, 9, 10:
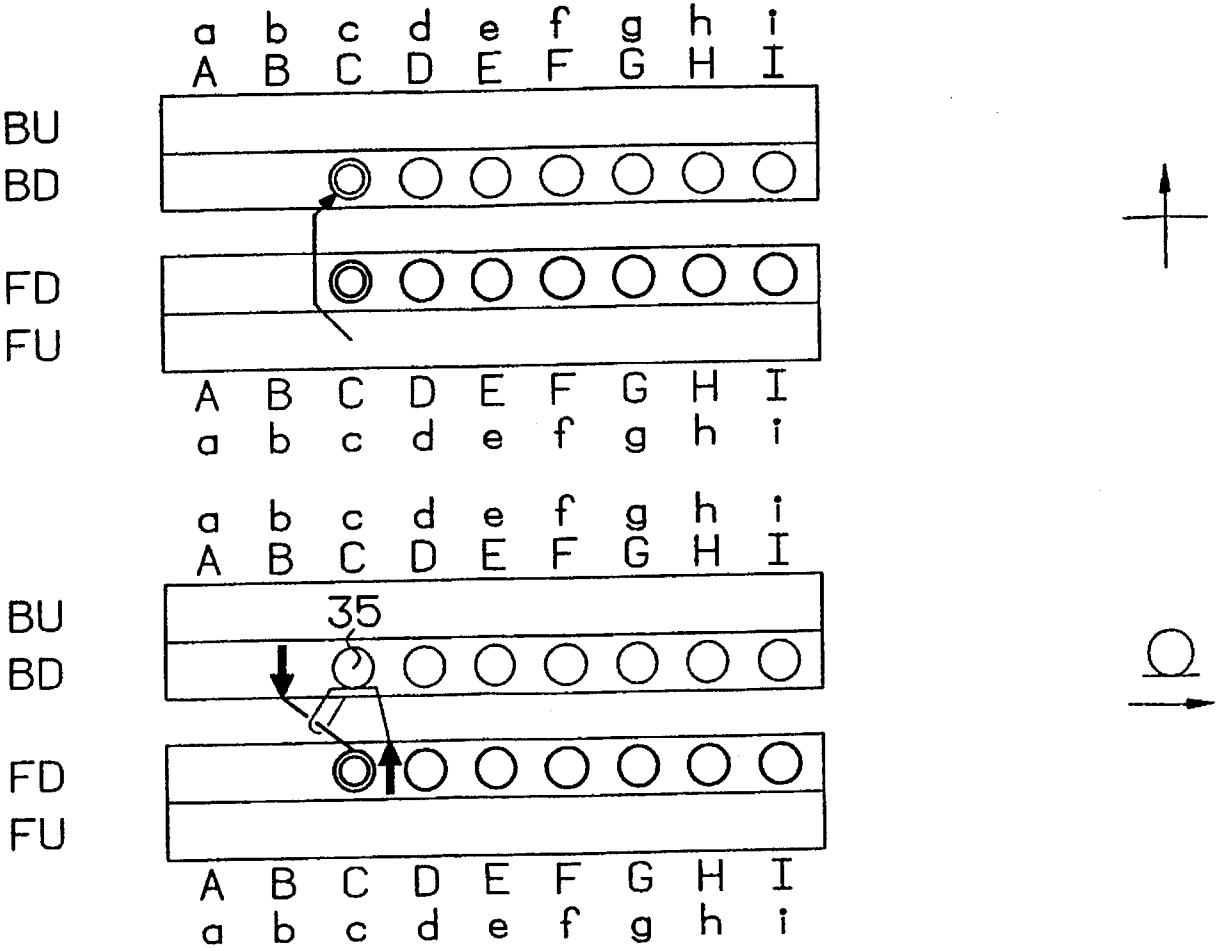
Figures 6, 7, 8, 9, 10, 11, 12:
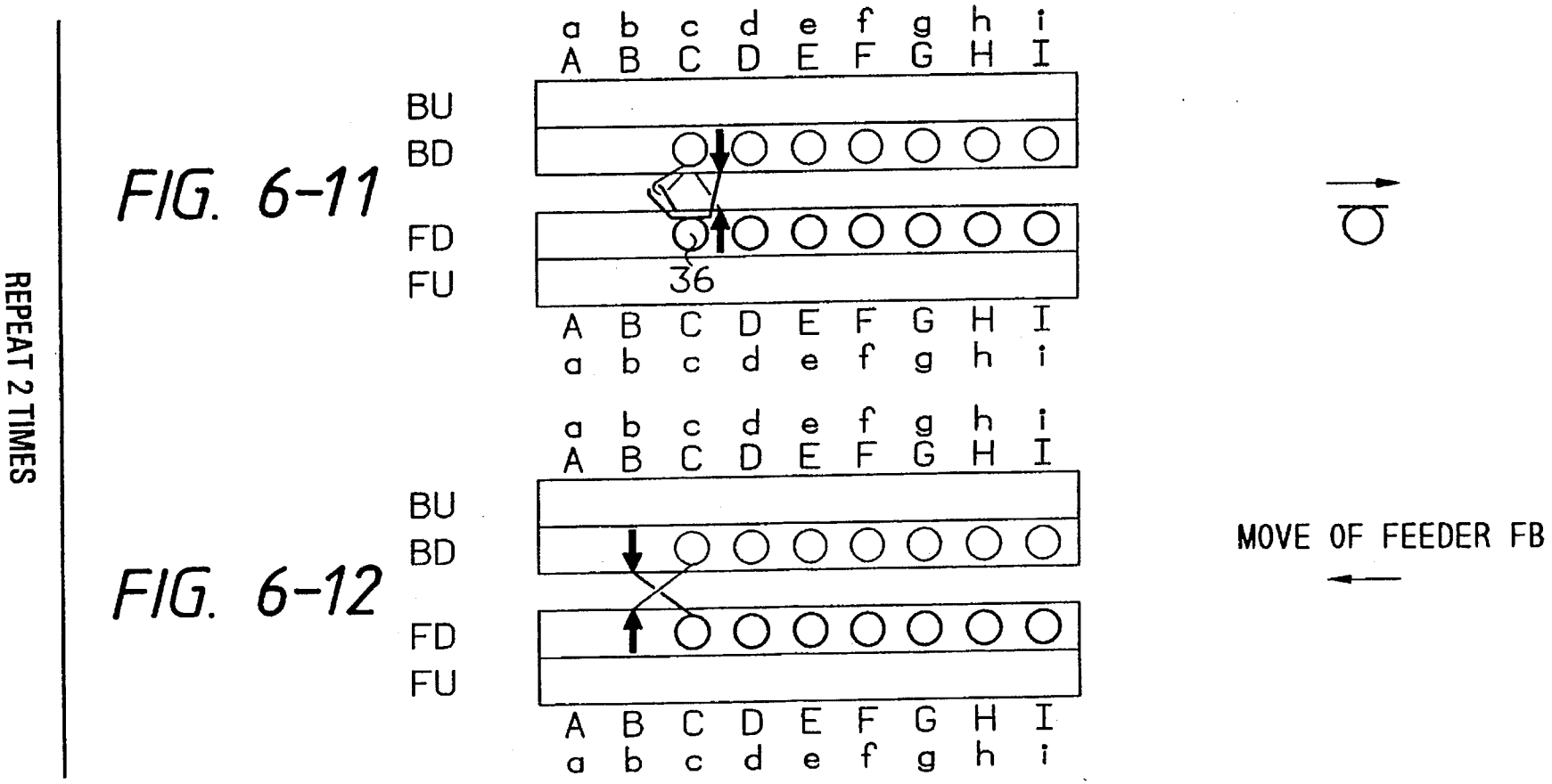
Figures 6, 7, 8, 9, 10, 11, 12, 13, 14:
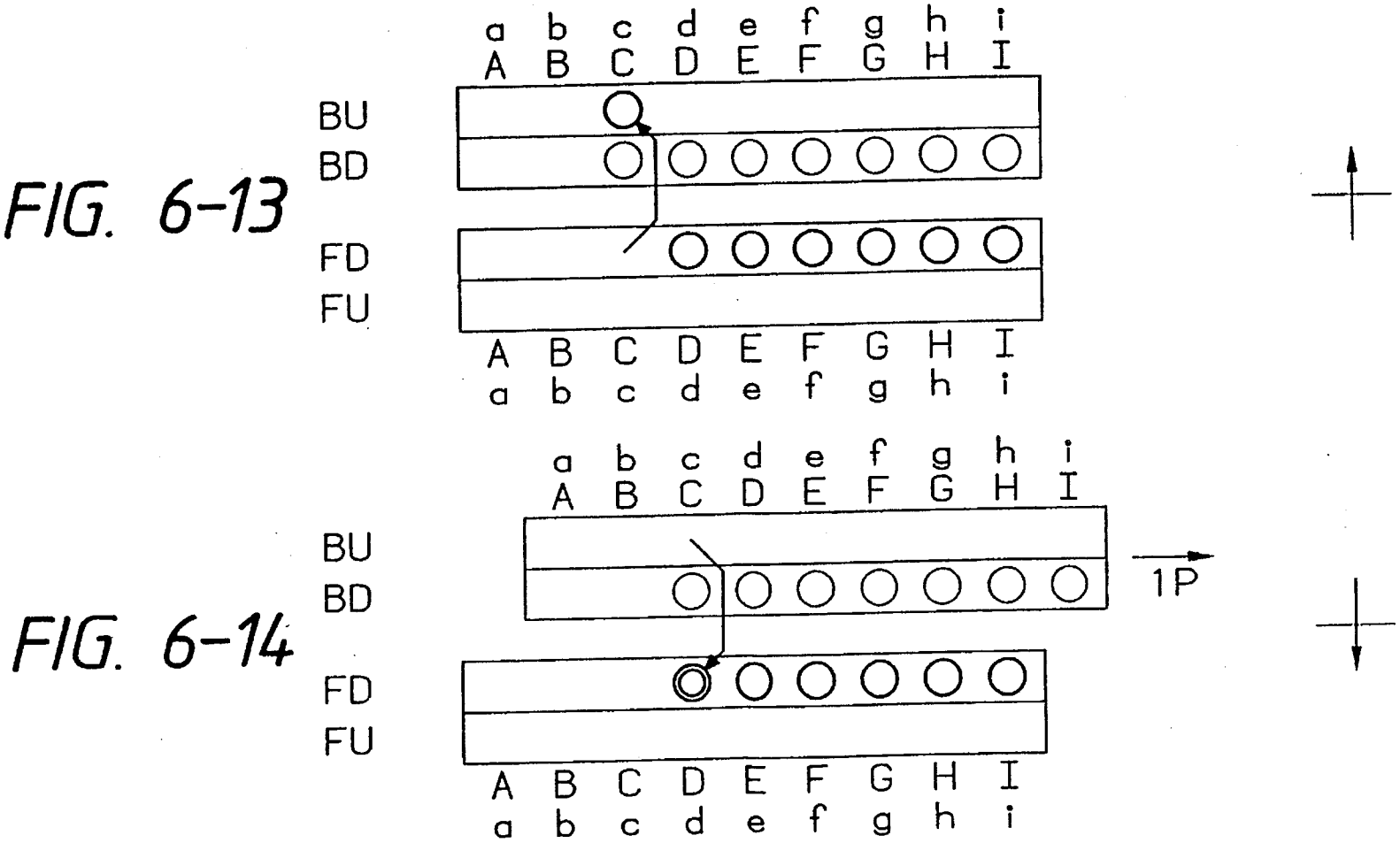
Figures 6, 7, 8, 9, 10, 11, 12, 13, 14, 15, 16:
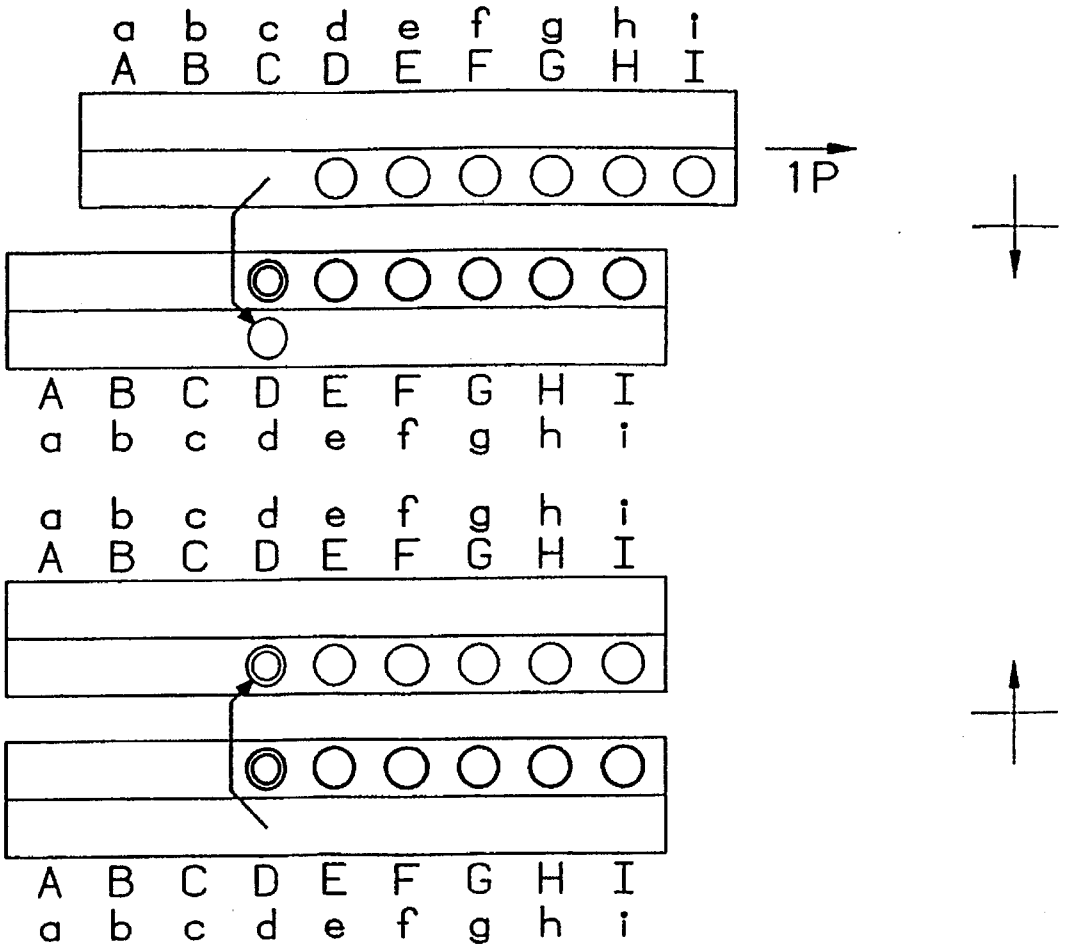
Figures 6, 7, 8, 9, 10, 11, 12, 13, 14, 15, 16, 17, 18:
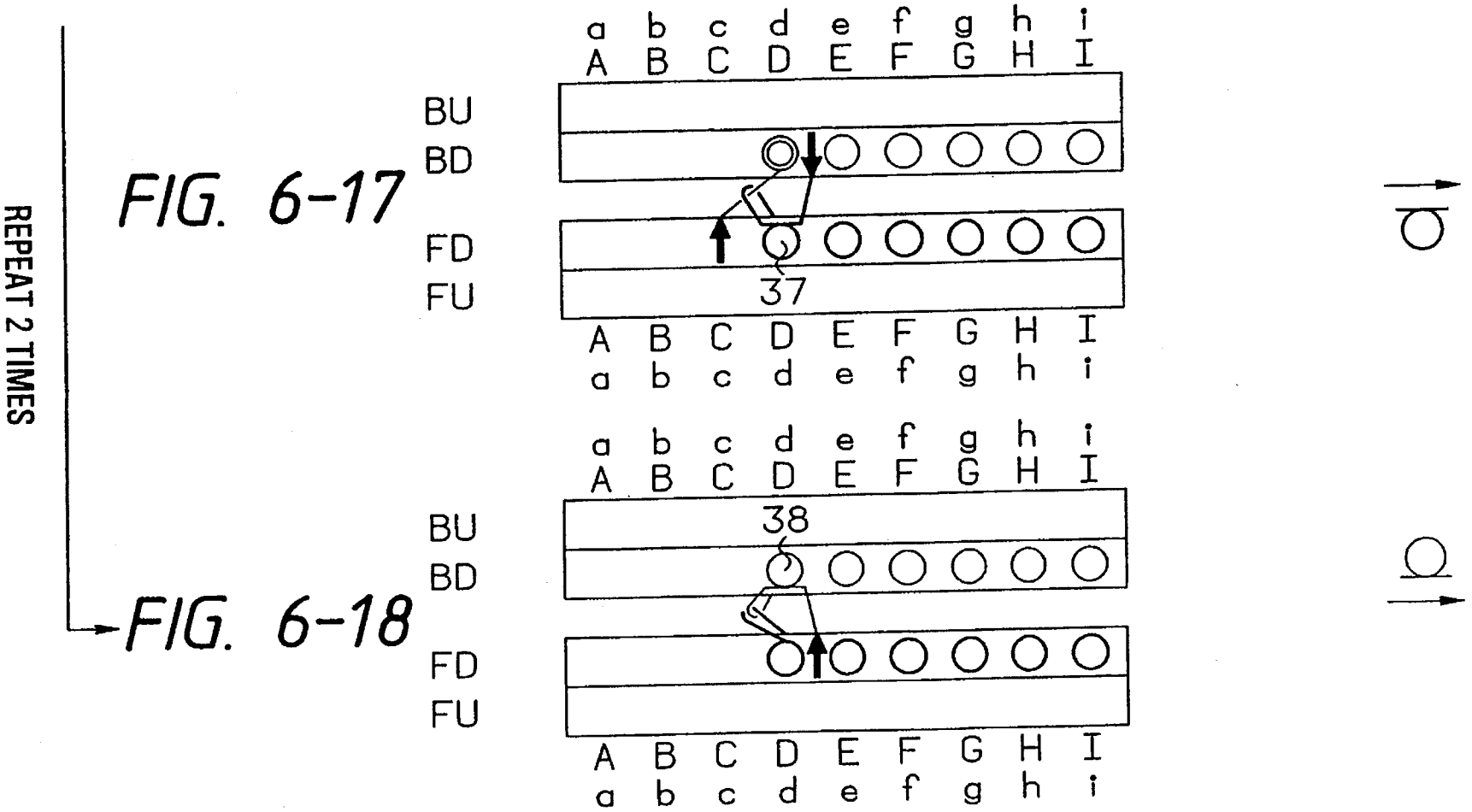
Figures 6, 7, 8, 9, 10, 11, 12, 13, 14, 15, 16, 17, 18, 19:
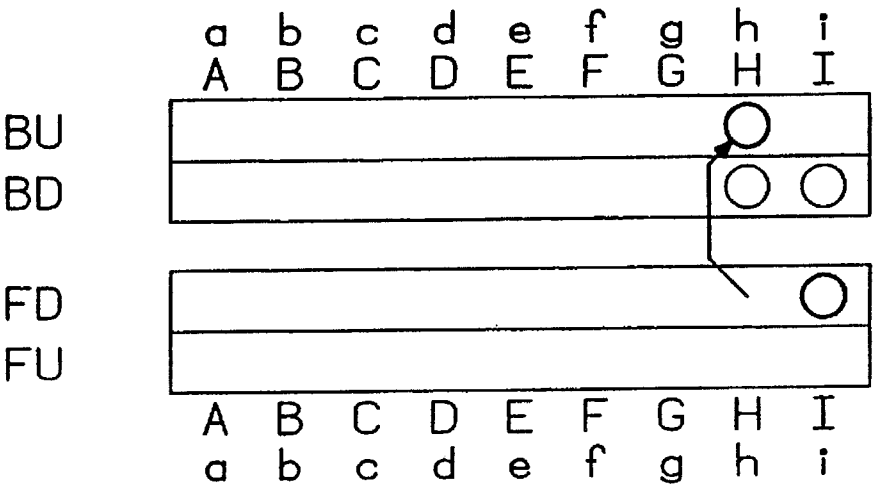
Figures 6, 7, 8, 9, 10, 11, 12, 13, 14, 15, 16, 17, 18, 19, 20:
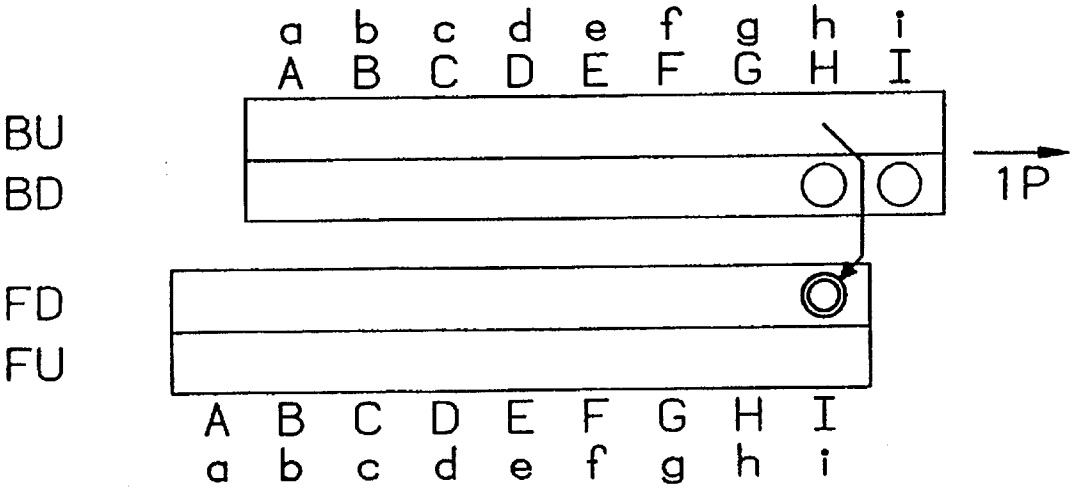
Figures 6, 7, 8, 9, 10, 11, 12, 13, 14, 15, 16, 17, 18, 19, 20, 21:
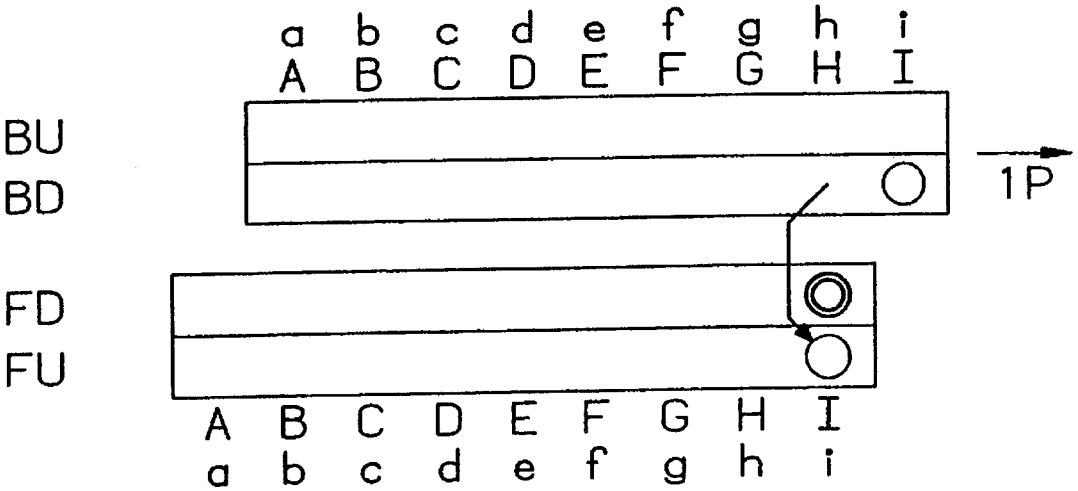
Figures 6, 7, 8, 9, 10, 11, 12, 13, 14, 15, 16, 17, 18, 19, 20, 21, 22:
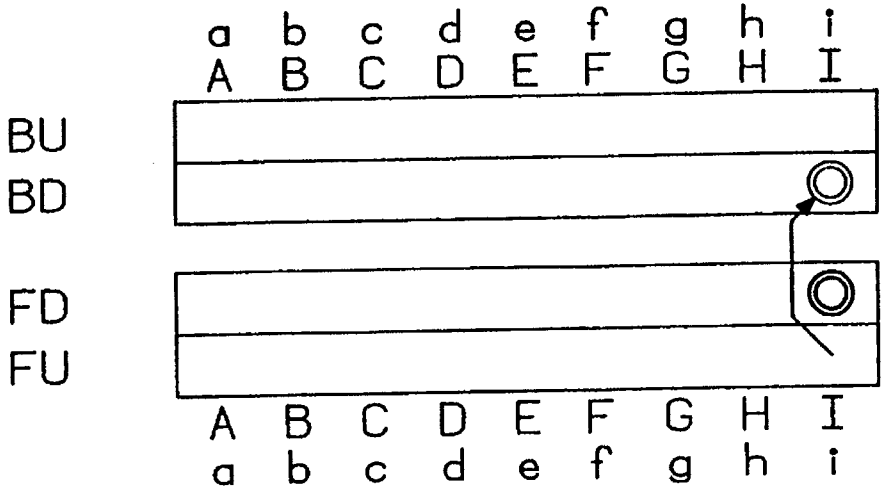
Figure 7:
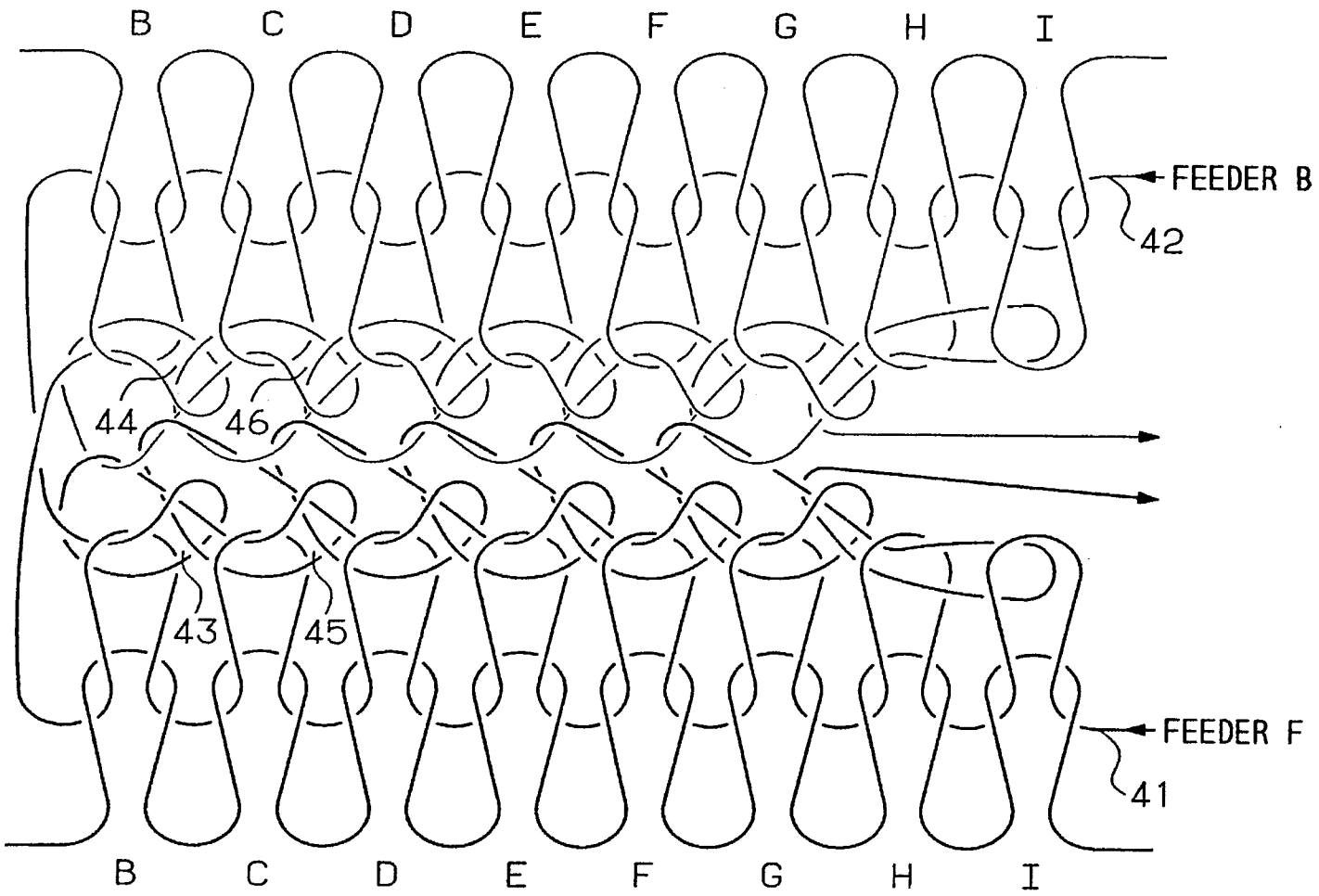
Figures 1, 2, 8:
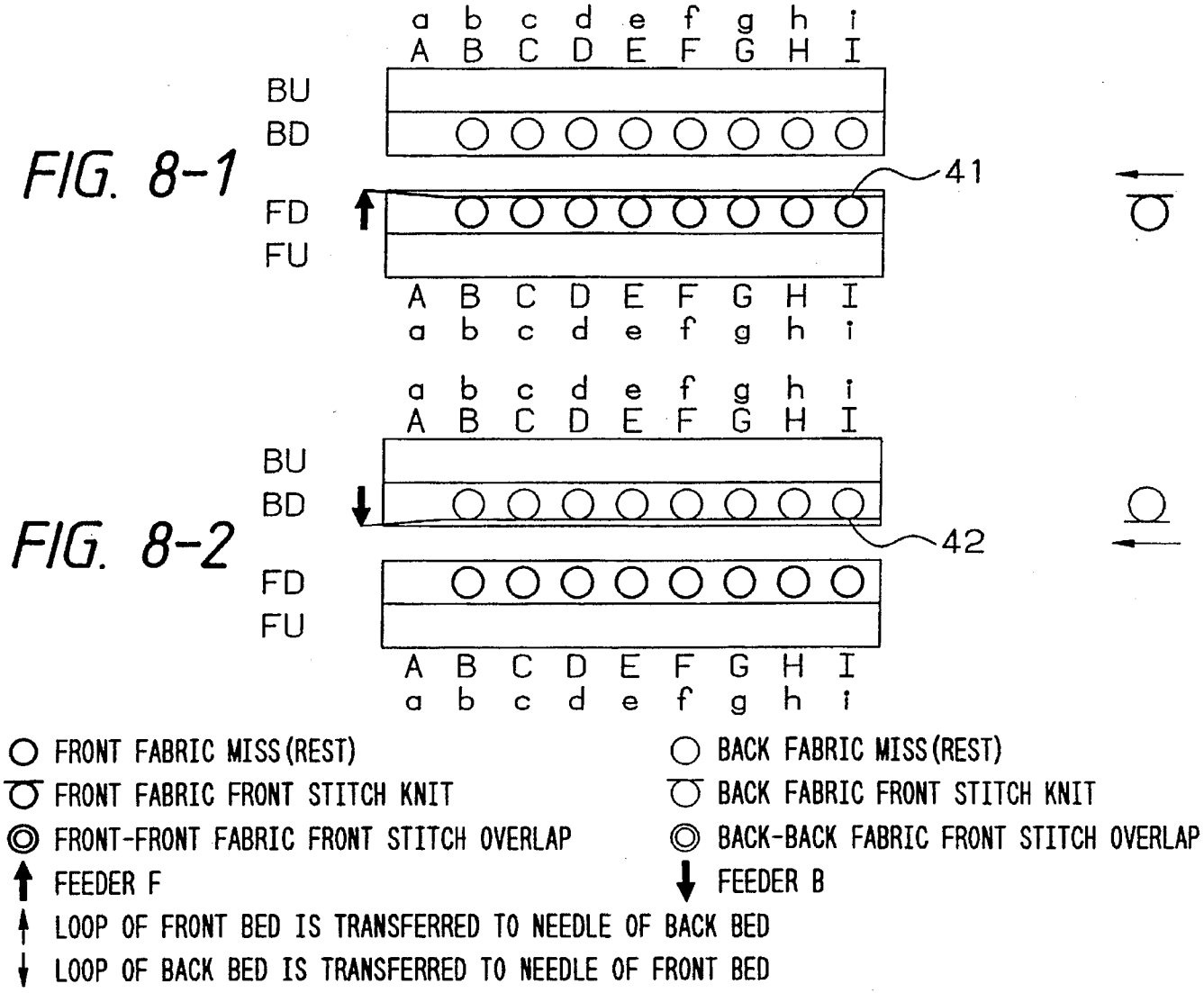
Figures 3, 4, 8:
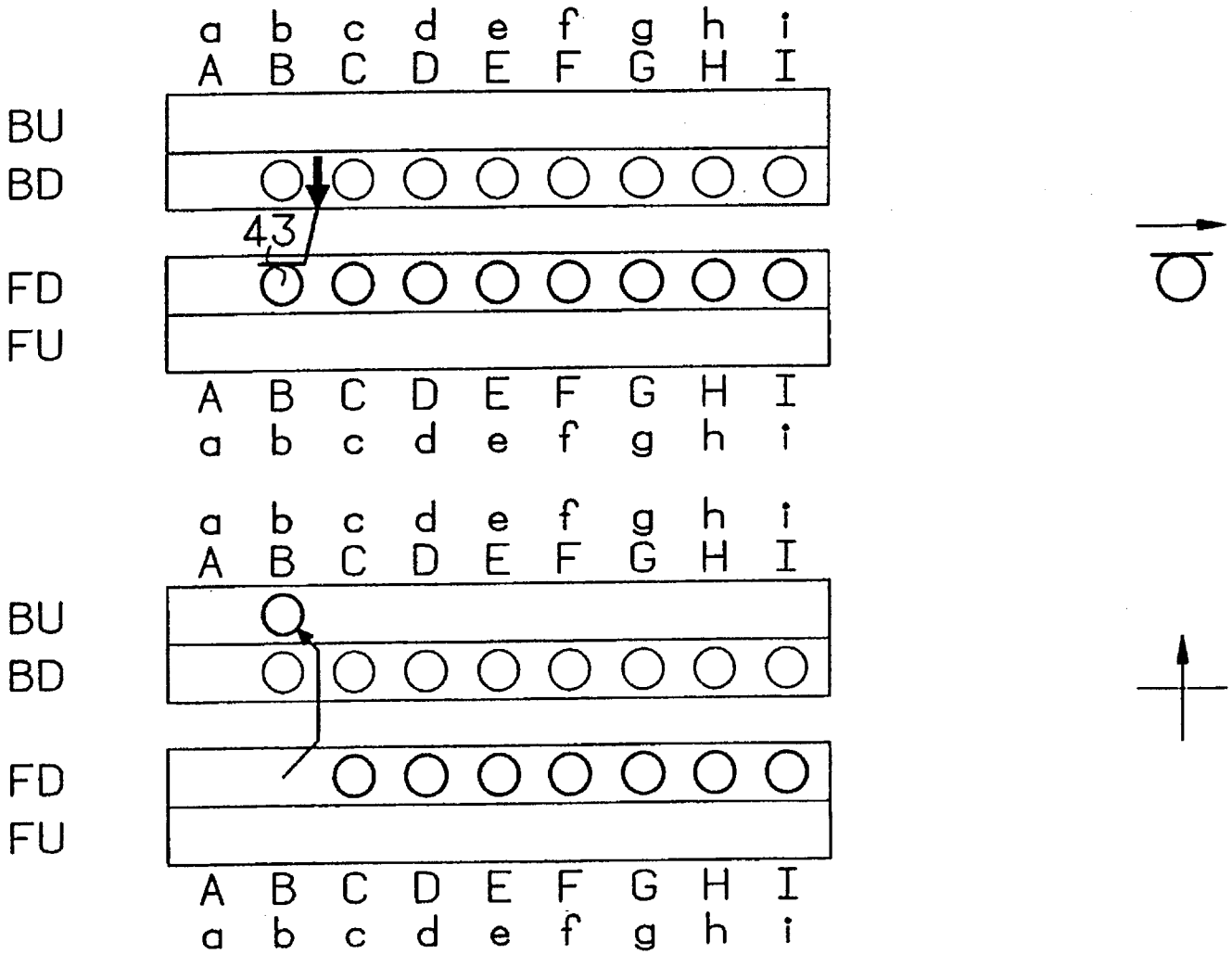
Figures 5, 6, 8:
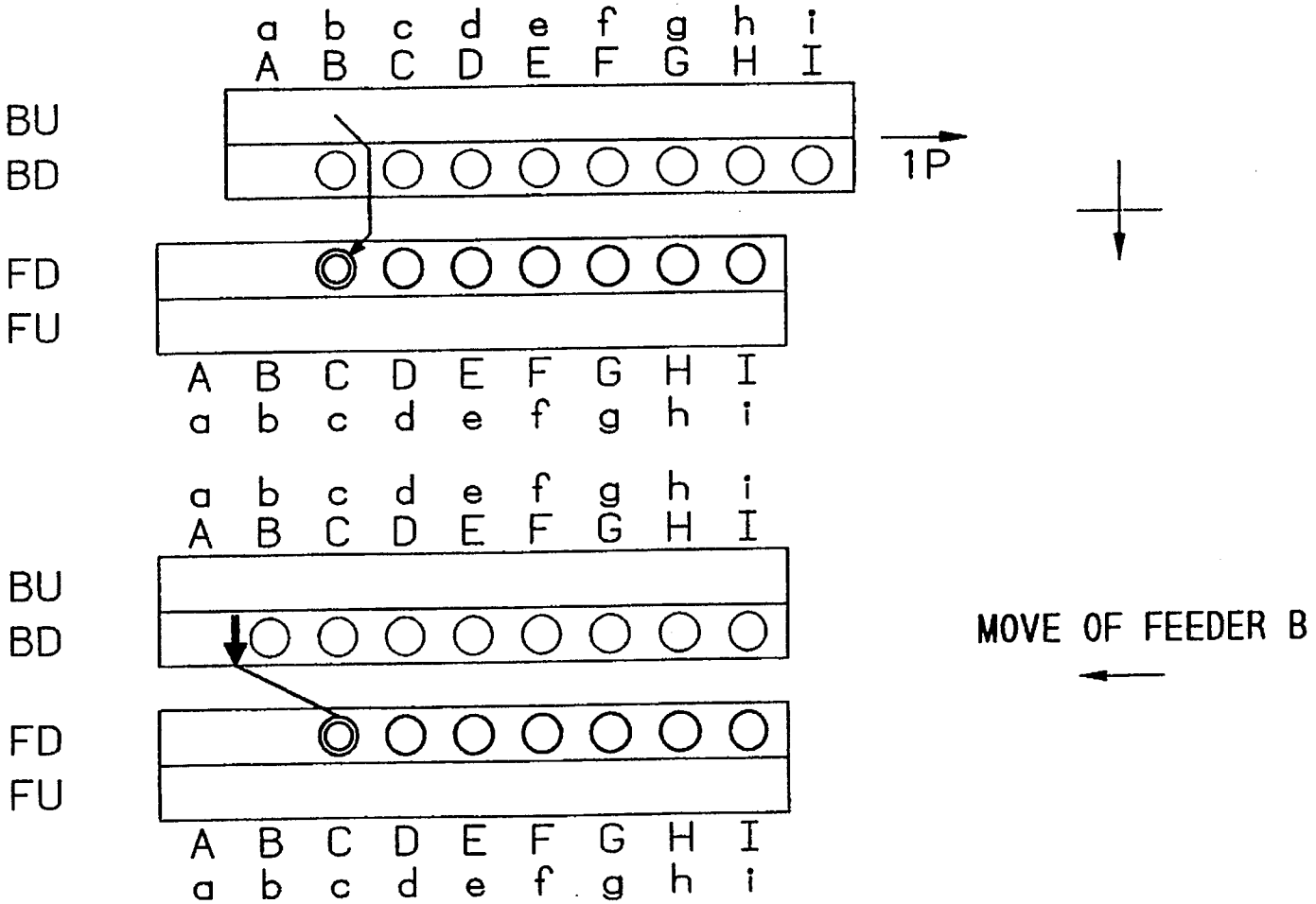
Figures 7, 8:
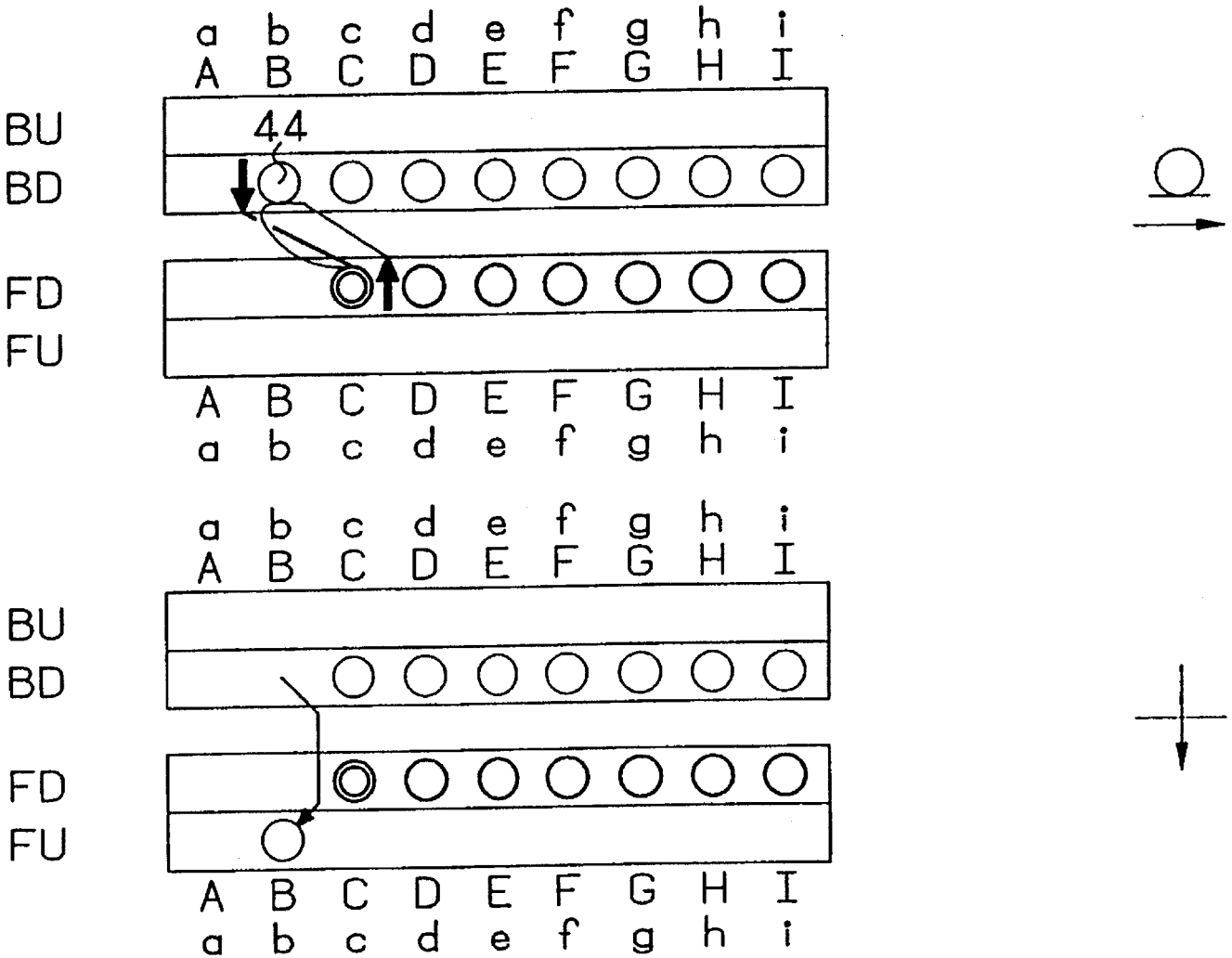
Figures 8, 9, 10:
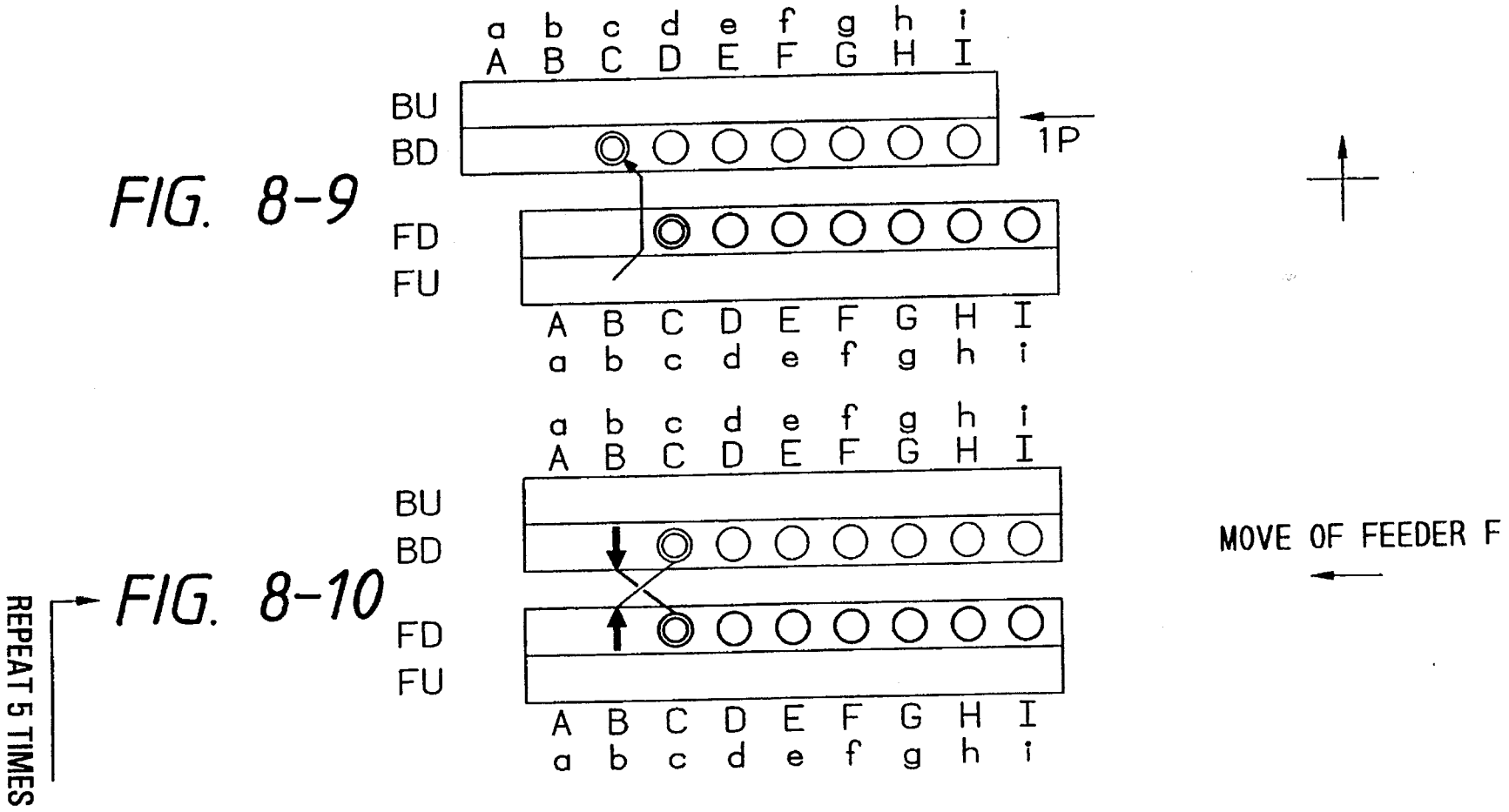
Figures 8, 9, 10, 11, 12:
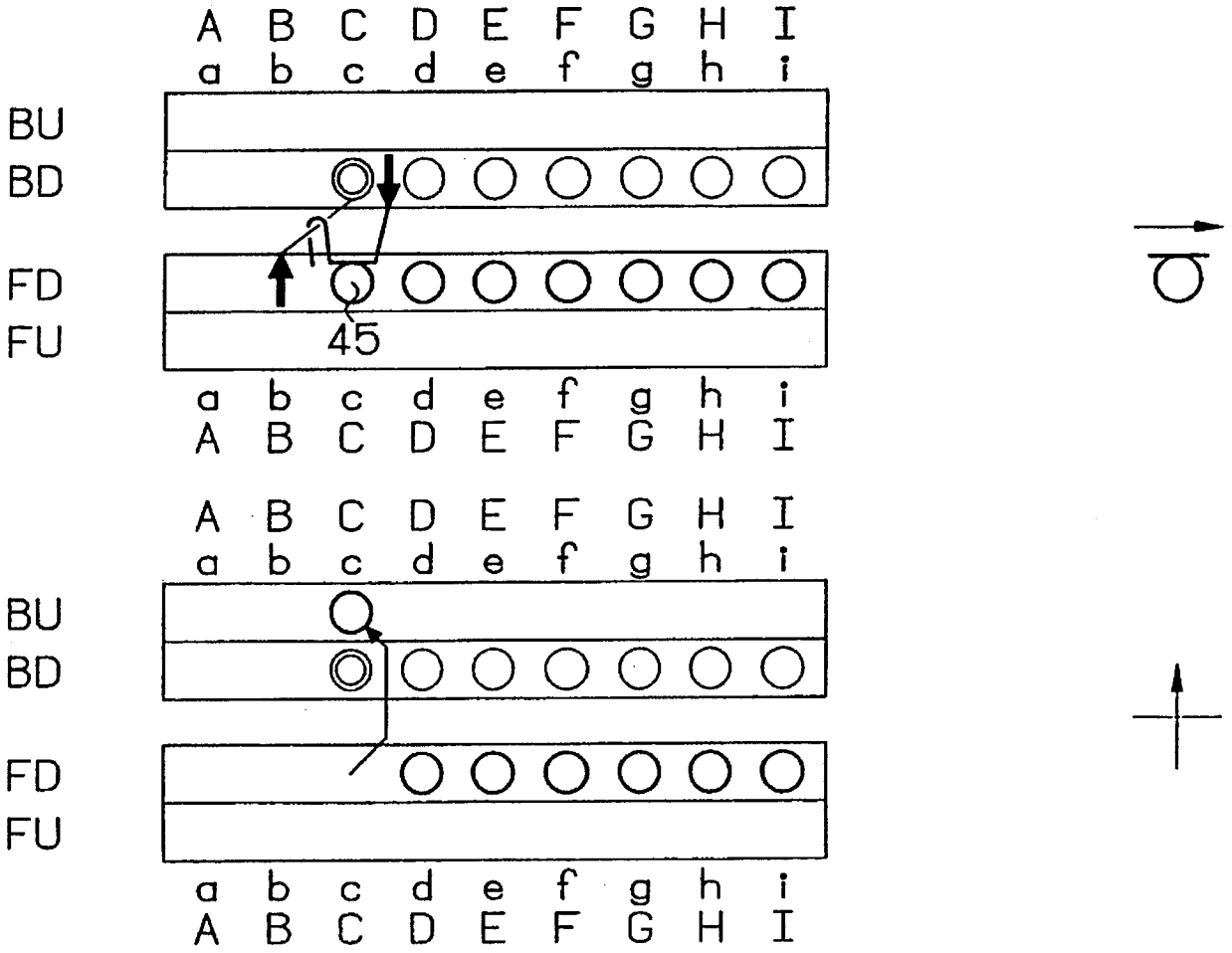
Figures 8, 9, 10, 11, 12, 13, 14:
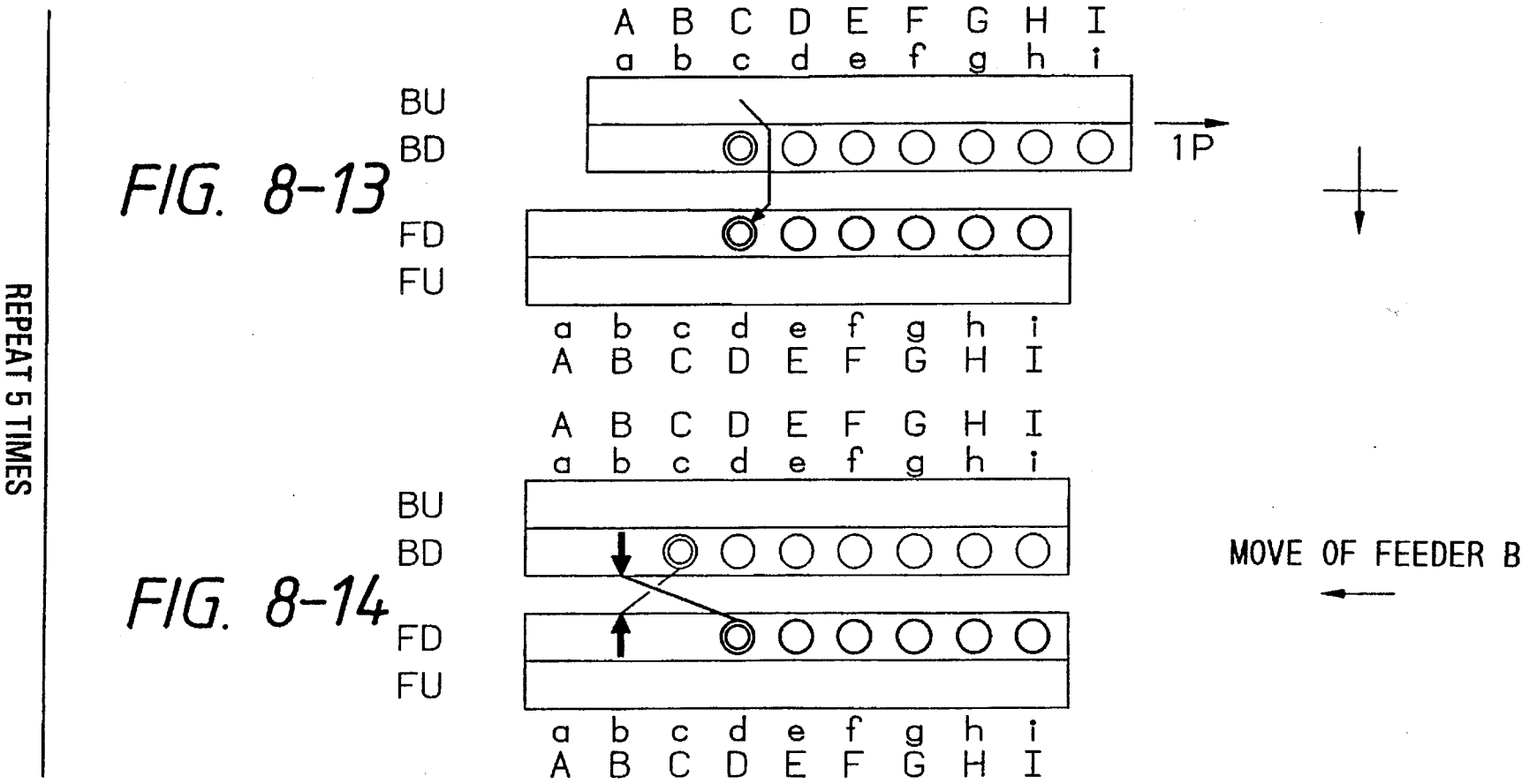
Figures 8, 9, 10, 11, 12, 13, 14, 15, 16:
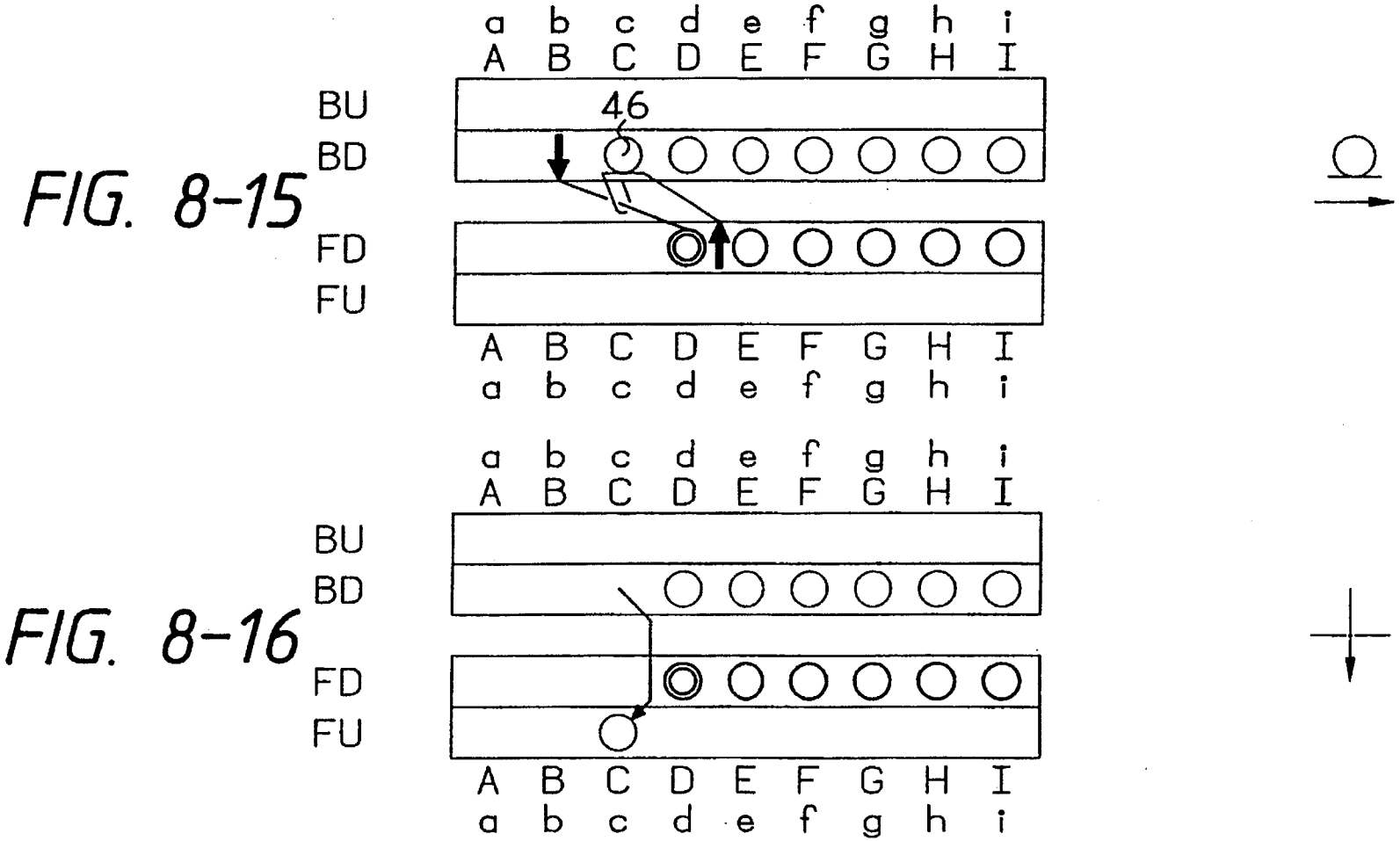
Figures 8, 9, 10, 11, 12, 13, 14, 15, 16, 17, 18:
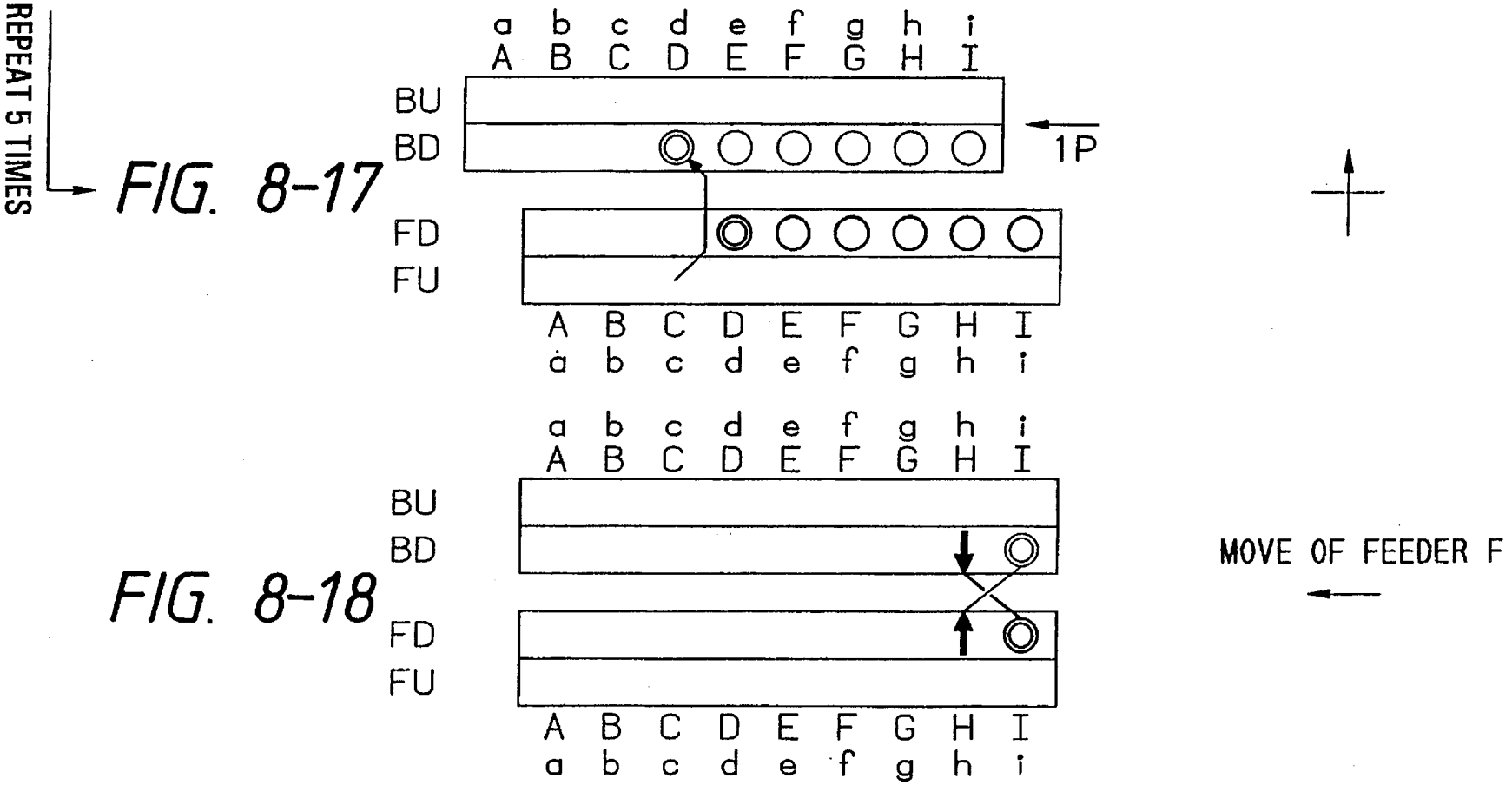
Figure 9:
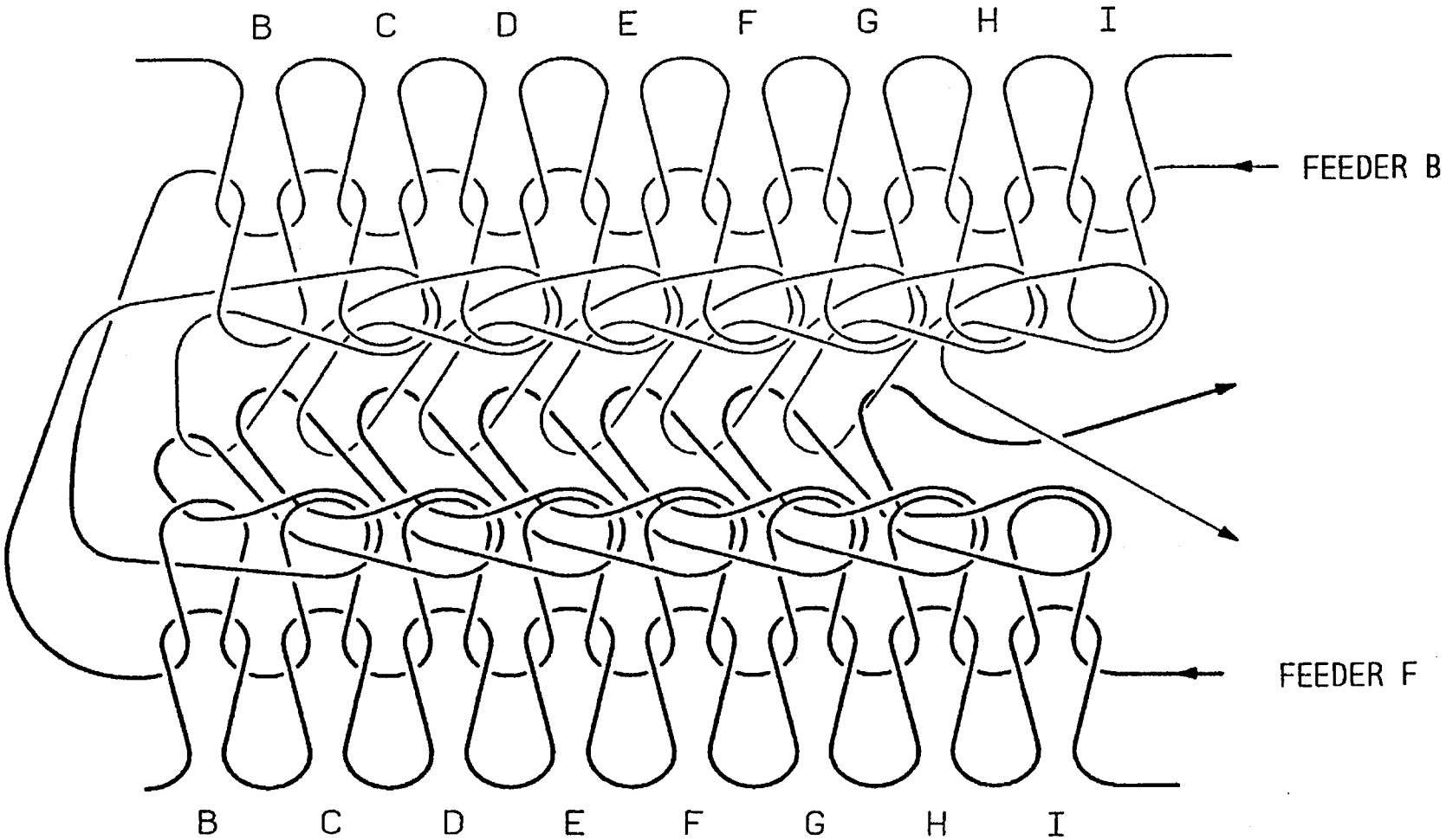
Figure 10:
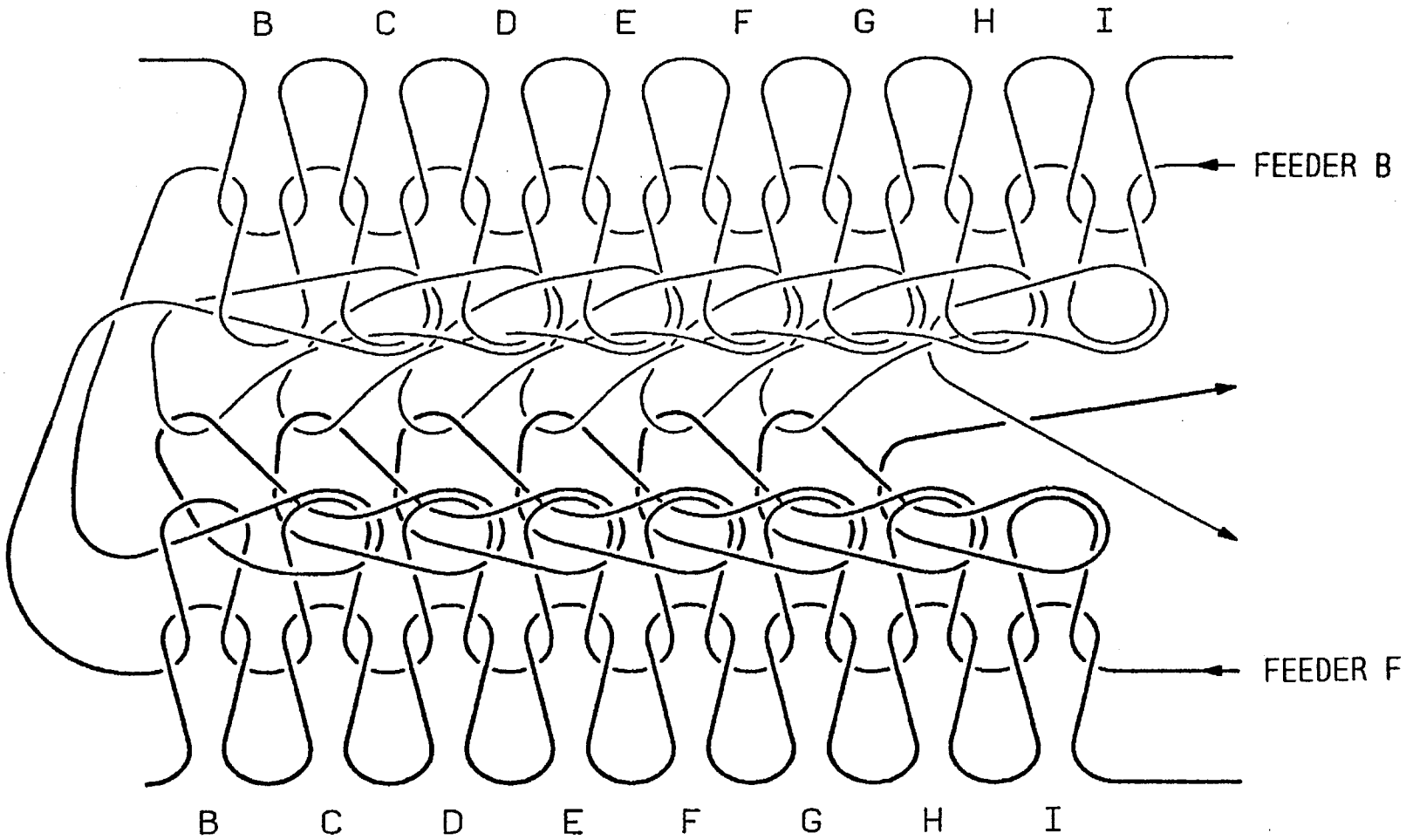
Figure 11:
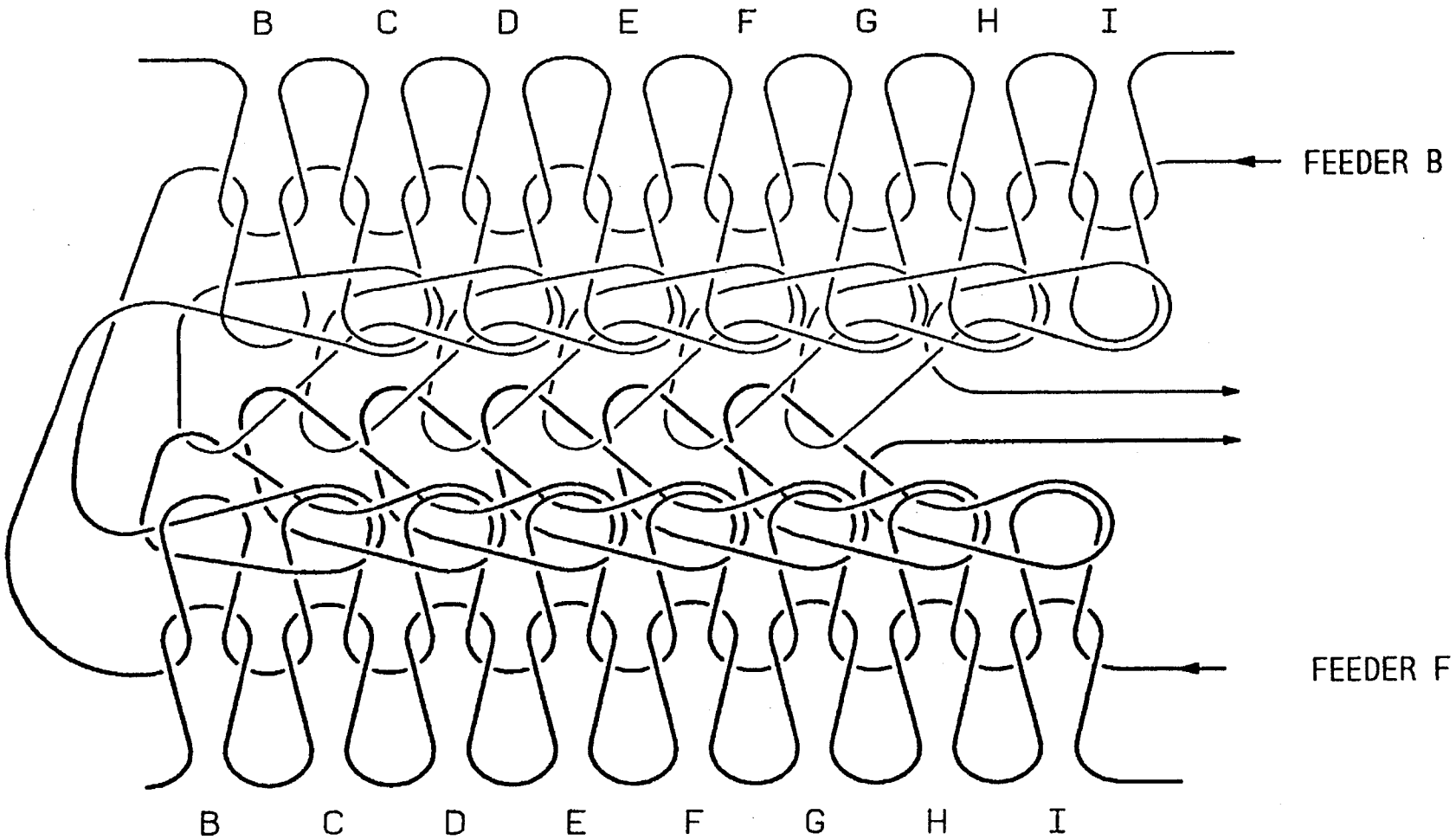

In FIG. 8-1, a yarn is fed to needles I, H, . . . C, B of the front bed FD by the feeder F to form a final course 41 of the front body part. In FIG. 8-2, yarns are fed by the feeder B to needles I, H, . . . C, B of the back bed BD to form a final course 42 of the back body part. In FIG. 8-3, a yarn is fed by the feeder B to the needle B of the front bed FD. The thus formed loop 43 is transferred to the adjacent needle C which holds the loop of the final course which is present in the front bed FD as shown in FIGS. 8-4 and 5 to form an overlap stitch. Next, the feeder B used to form the loop 43 is moved leftward of fabric (FIG. 8-6). When a yarn is fed by the feeder F to the needle B of the back bed BD (formation of a loop 44) in the state of positional relation of the feeders F and B, the yarns of the feeders F and B cross and are intertwined each other and connected (FIG. 8-7). The formed loop 44 is transferred to the adjacent needle C which holds the loop of the final course which is present in the back bed BD (FIGS. 8-8 and 9). Next, the feeder F used to form the loop 44 is moved leftward of fabric and crosses above the yarn of the feeder B (FIG. 8-10).

In FIG. 8-11, a yarn is fed by the feeder B to the needle C of the front bed FD to form a loop 45. The formed loop 45 is transferred to the adjacent needle D which holds the loop of the final course which is present in the front bed FD as shown in FIGS. 8-12 and 13 to form an overlap stitch. Next, the feeder B used to form the loop 45 is moved leftward of fabric (FIG. 8-14). In FIG. 8-15, a yarn is fed by the feeder F to the needle C of the back bed BD to form a loop 46. The formed loop 46 is moved to the adjacent needle D which holds the loop of the final course which is present in the back bed BD as shown in FIGS. 8-16 and 17 to form a stitch knit. Thereafter, the knitting shown in FIGS. 8-10 to 8-17 is repeatedly applied to successive needles, and loops of fabrics engaged in the needles of the front bed FD and the back bed BD are connected in the intertwined state and the loops held on the needle bed are sequentially reduced while being applied with the anti-raveling processing. In the case of the present embodiment, such processing is repeated five times to effect processing till the final needles I, i. The feeder used to form the loop 46 is then moved leftward of fabric (FIG. 8-18). Thereafter, the anti-raveling is applied by the method similar to that of Embodiment 1, though not shown, to terminate knitting.

A loop view shown in FIG. 9 is fundamentally the same as Embodiment 1 except that the overlapping of loops to be transferred is reversed. FIG. 10 shows a modified example of Embodiment 2. FIG. 11 shows a modified example of Embodiment 3.

The knitting method of the present invention is characterized in that a tubular or a plurality of front and back fabrics are connected by intertwining yarns at end portion of fabric and the anti-raveling processing is applied to the end portion of fabric. The present invention is not limited to the above-described embodiments. While in the above-described embodiments, the feed of yarn by the respective feeders continuous to the final course has been applied to every single needle, it is to be noted that yarns can be successively fed to two needles adjacent to each other to effect the processing of end portion of fabric without departing the scope of the present invention. (Effect of the Invention)

As is apparent from the above-described embodiments, according to the fabric and knitting method of the present invention, both fabrics engaged in the needles of the front bed and the back bed are connected and integrated only by the intertwining of yarns used for knitting of the anti-raveling processing. Therefore, both the fabrics are not overlapped each other as in prior art. It is therefore not necessary that a new loop is formed on the overlapped loops to carry out the anti-raveling processing. Thus, there occurs no finish such that the joined portion of fabrics is projected out of the surface of the fabric, and the beauty of the fabric product is not injured.

We claim:

1. A method for processing the end portion of a first fabric and the end portion of a second fabric, comprising providing a flat knitting machine having a first bed and a second bed, the first bed having a head portion and the second bed having a head portion, the head portion of the first bed and the head portion of the second bed being in opposed relationship, the first bed having a plurality of needles for holding a final course of the first fabric and the second bed having a plurality of needles for holding a final course of the second fabric, providing a first yarn feeder and a second yarn feeder which travel in different orbits with respect to the needles of the first bed and the needles of the second bed, feeding a yarn from the first yarn feeder to a needle of the second bed and feeding a yarn from the second yarn feeder to a needle of the first bed, intertwining the yarns fed from both of the yarn feeders with each other to form a loop of fabric which is continuous with at least one of the final course of the first fabric and the final course of the second fabric, transferring the formed loop of fabric from at least one of a needle of the first bed to an adjacent needle of the second bed and a needle of the second bed to an adjacent needle of the first bed to thereby overlap the formed loop, and repeating the feeding, intertwining and transferring steps, and integrally connecting the first fabric and the second fabric while holding loops in the final course so as not to be released, thereby forming a flat connected portion between the first and second fabrics.

2. The method as in claim 1, wherein the knitting machine defines a first direction and a second, substantially opposite direction, and wherein the step of integrally connecting the first fabric and the second fabric comprises:

moving the first yarn feeder in the first direction;

moving the second yarn feeder in the second direction to provide a yarn to be intertwined with a loop formed in the first fabric;

transferring the loop formed in the first fabric from a needle of the first bed to an adjacent needle of the first bed to thereby overlap the loop;

moving the second yarn feeder in the first direction;

moving the first yarn feeder in the second direction to provide a yarn to be intertwined with a loop formed in the second fabric; and transferring the loop formed in the second fabric from a needle of the second bed to an adjacent needle of the second bed to thereby overlap the loop.

3. The method as in claim 1, wherein the knitting machine defines a first direction and a second, substantially opposite direction, and wherein the step of integrally connecting the first fabric and the second fabric comprises:

moving the first yarn feeder and the second yarn feeder in the second direction;

transferring an end loop of a needle of a first bed to an adjacent needle of the first bed to thereby overlap the loop;

transferring an end loop of a needle of a second bed to an adjacent needle of the second bed to thereby overlap the loop;

moving the first yarn feeder in the first direction to provide a yarn to be intertwined with a loop formed in the second fabric; and moving the second yarn feeder in the first direction to provide a yarn to be intertwined with a loop formed in the first fabric.

4. The method as in claim 1, wherein the knitting machine defines a first direction and a second, substantially opposite direction, and wherein the step of integrally connecting the first fabric and the second fabric comprises:

moving the first yarn feeder in the second direction;

moving the second yarn feeder in the first direction to provide a yarn to be intertwined with a loop formed in the first fabric;

transferring the loop formed in the first fabric from a needle of the first bed to an adjacent needle of the first bed to thereby overlap the loop;

moving the second yarn feeder in the second direction;

moving the first yarn feeder in the first direction to provide a yarn to be intertwined with a loop formed in the second fabric; and transferring the loop formed in the second fabric from a needle of the second bed to an adjacent needle of the second bed to thereby overlap the loop.

* * * * *